US008308489B2

(12) United States Patent
Lee et al.

(10) Patent No.: US 8,308,489 B2
(45) Date of Patent: Nov. 13, 2012

(54) ELECTRICAL GARMENT AND ELECTRICAL GARMENT AND ARTICLE ASSEMBLIES

(75) Inventors: Kang S. Lee, Woodland Hills, CA (US); Thomas Forrester, Hacienda Heights, CA (US); Eric Gans, Los Angeles, CA (US); Kevin Carl Walter, Aliso Viejo, CA (US); David J. Silvestris, Torrance, CA (US); Tomasz Jannson, Torrance, CA (US)

(73) Assignee: Physical Optics Corporation, Torrance, CA (US)

( * ) Notice: Subject to any disclaimer, the term of this patent is extended or adjusted under 35 U.S.C. 154(b) by 881 days.

(21) Appl. No.: 12/259,203

(22) Filed: Oct. 27, 2008

(65) Prior Publication Data

US 2010/0100997 A1 Apr. 29, 2010

(51) Int. Cl.
*H01R 33/00* (2006.01)

(52) U.S. Cl. ..... 439/37; 2/69

(58) Field of Classification Search ..... 439/37; 2/69

See application file for complete search history.

(56) References Cited

U.S. PATENT DOCUMENTS

| | | | | |
|---|---|---|---|---|
| 2,021,111 | A | 11/1935 | Wheat | |
| 2,824,290 | A | 2/1958 | Archer et al. | |
| 3,521,216 | A | 7/1970 | Tolegian | |
| 3,555,695 | A | 1/1971 | Dunn | |
| 3,663,796 | A * | 5/1972 | Hines et al. | 219/211 |
| 3,790,858 | A | 2/1974 | Brancaleone | |
| 4,034,172 | A | 7/1977 | Glover et al. | |
| 4,087,297 | A | 5/1978 | Johnson | |
| 4,308,572 | A | 12/1981 | Davidson | |
| 4,480,293 | A | 10/1984 | Wells | |
| 4,570,206 | A | 2/1986 | Deutsch | |

(Continued)

FOREIGN PATENT DOCUMENTS

| | | |
|---|---|---|
| WO | 9820505 | 5/1998 |

(Continued)

OTHER PUBLICATIONS

Jannson, T.P., Kostrzewski, A.A., Lee, K.S., Hester, T.J., Forrester, T.C., Savant, G.D., "Soft Computing and Small System Integration." Applications of Digital Image Processing XXVII, Aug. 2-6, 2004, Denver, CO.

(Continued)

*Primary Examiner* — Gary F. Paumen

(74) *Attorney, Agent, or Firm* — Sheppard Mullin Richter & Hampton LLP

(57) ABSTRACT

Electrical garments and components for use in electrical garments are provided. A communication medium of various forms is integrated into a garment seam that is used to join two or more portions of a garment. The communication media can be used to provide electrical or other electromagnetic connection for coupling among a plurality of electrical devices associated with the garment. Accordingly, the electrical garment can be configured for a plurality of uses, applications and environments, depending on the electrical devices associated therewith. The electrical devices can be configured to be attached to or integrated with the garment in a releasable fashion or in a more permanent configuration. The electrical devices can be chosen for their desired functionality and interconnected with the communication media, which is at least partially integrated within the garment seams. Additional embodiments provide an electronic connector suitable for use with seams incorporating electronic wiring. The connector provides additional flexibility in constructing the electric garment as additional items may be incorporated into the electronic capabilities of the garment.

26 Claims, 17 Drawing Sheets

U.S. PATENT DOCUMENTS

| | | | | |
|---|---|---|---|---|
| 4,602,191 | A | 7/1986 | Davila | |
| 4,728,751 | A | 3/1988 | Canestaro | |
| 4,752,351 | A | 6/1988 | Lunt | |
| 4,774,434 | A | 9/1988 | Bennion | |
| 4,785,136 | A | 11/1988 | Mollet | |
| 4,885,570 | A | 12/1989 | Chien | |
| 4,950,171 | A | 8/1990 | Muzslay | |
| 4,975,317 | A | 12/1990 | Kuhn | |
| 5,145,408 | A | 9/1992 | Houtteman | |
| 5,290,191 | A | 3/1994 | Foreman | |
| 5,375,044 | A | 12/1994 | Guritz | |
| 5,455,749 | A | 10/1995 | Ferber | |
| 5,497,140 | A | 3/1996 | Tuttle | |
| 5,551,882 | A | 9/1996 | Whiteman | |
| 5,586,668 | A | 12/1996 | Miller | |
| 5,624,736 | A | 4/1997 | DeAngelis et al. | |
| 5,646,592 | A | 7/1997 | Tuttle | |
| 5,656,990 | A | 8/1997 | Schwimmer | |
| 5,704,792 | A | 1/1998 | Sobhani | |
| 5,785,181 | A | 7/1998 | Quartararo | |
| 5,906,004 | A | 5/1999 | Lebby | |
| 5,973,598 | A | 10/1999 | Beigel | |
| 5,986,562 | A | 11/1999 | Nikolich | |
| 6,013,346 | A | 1/2000 | Lewis | |
| 6,026,512 | A * | 2/2000 | Banks | 2/69 |
| 6,080,690 | A | 6/2000 | Lebby | |
| 6,243,870 | B1 | 6/2001 | Graber | |
| 6,254,403 | B1 | 7/2001 | Bernardini | |
| 6,261,360 | B1 | 7/2001 | Dry | |
| 6,324,053 | B1 | 11/2001 | Kamijo | |
| 6,350,129 | B1 | 2/2002 | Gorlick | |
| 6,381,482 | B1 | 4/2002 | Jayaraman | |
| 6,412,701 | B1 | 7/2002 | Kohama | |
| 6,420,008 | B1 | 7/2002 | Lewis | |
| 6,518,330 | B2 | 2/2003 | White et al. | |
| 6,573,456 | B2 | 6/2003 | Spruell | |
| 6,727,197 | B1 | 4/2004 | Wilson | |
| 6,729,025 | B2 | 5/2004 | Farrell | |
| 6,767,218 | B2 | 7/2004 | Marmaropoulos | |
| 6,805,568 | B2 | 10/2004 | Kuzmenka | |
| 6,895,261 | B1 | 5/2005 | Palamides | |
| 6,939,142 | B2 | 9/2005 | Maruyama | |
| 6,957,345 | B2 | 10/2005 | Cesana | |
| 7,094,084 | B2 | 8/2006 | Lee | |
| 7,151,455 | B2 | 12/2006 | Lindsay | |
| 7,297,002 | B2 | 11/2007 | Kostrzewski | |
| 7,302,145 | B2 | 11/2007 | Huston | |
| 7,335,067 | B2 | 2/2008 | Lee | |
| 7,344,379 | B2 * | 3/2008 | Marmaropoulos et al. | 439/37 |
| 7,462,035 | B2 * | 12/2008 | Lee et al. | 439/37 |
| 7,559,768 | B2 * | 7/2009 | Marmaropoulos et al. | 439/37 |
| 7,783,334 | B2 * | 8/2010 | Nam et al. | 600/388 |
| 2001/0056542 | A1 | 12/2001 | Cesana | |
| 2002/0045363 | A1 * | 4/2002 | Tilbury et al. | 439/37 |
| 2003/0040247 | A1 | 2/2003 | Rehkemper | |
| 2004/0133088 | A1 | 7/2004 | Al-Ali | |
| 2005/0012619 | A1 | 1/2005 | Sato | |
| 2005/0136257 | A1 | 6/2005 | Easter | |
| 2005/0242297 | A1 | 11/2005 | Walker | |
| 2005/0242950 | A1 | 11/2005 | Lindsay | |
| 2005/0253708 | A1 | 11/2005 | Bohman | |
| 2006/0125642 | A1 | 6/2006 | Chandaria | |
| 2006/0128169 | A1 | 6/2006 | Marmaropoulos | |
| 2006/0172719 | A1 | 8/2006 | Chen | |
| 2006/0214789 | A1 | 9/2006 | Posamentier | |
| 2006/0246744 | A1 * | 11/2006 | Marmaropoulos et al. | 439/37 |
| 2007/0015404 | A1 | 1/2007 | Shisler | |
| 2007/0026695 | A1 | 2/2007 | Lee | |
| 2007/0026696 | A1 | 2/2007 | Kostrzewski | |
| 2009/0218854 | A1 * | 9/2009 | Pfahler et al. | 297/180.12 |
| 2009/0289046 | A1 * | 11/2009 | Richmond | 219/211 |

FOREIGN PATENT DOCUMENTS

| | | |
|---|---|---|
| WO | 0136728 | 5/2001 |
| WO | 2005013738 | 2/2005 |
| WO | 2007015786 | 2/2007 |
| WO | 2007032816 | 3/2007 |

OTHER PUBLICATIONS

Kostrzewski, A.A., Lee, K.S., Gans, E., Winterhalter, C.A., Jannson, T.P., "Innovative Wearable Snap Connector Technology for Improved Networking in Electric Garments," Sensors, and Command, Control, Communications, and Intelligence (C31) Technologies for Homeland Security and Homeland Defense VI, Apr. 9-12, 2007, Orlando, FL.

Farringdon, Jonny, Moore, Andrew J., Tilbury, Nancy, Church, James, Biemond, Peter D., "Wearable Sensor Badge and Sensor Jacket for Context Awareness," IEEE, 1999, pp. 107-121.

Post, E. Rehmi, Orth, Maggie, "Smart Fabric, or Washable Computing," IEEE, Oct. 13-14, 1997, pp. 167-168, Cambridge, MA.

Post, E.R., Orth, M., Russo, P.R., Gersherfeld, N., "E-broidery: Design and Fabrication of Textile-Based Computing," IBM Systems Journal, 2000, vol. 39 No. 354, pp. 840-860.

Post, Rehmi E., Reynolds, Matt, Gray, Matthew, Paradiso, Joe, Gershenfeld, "Intrabody Buses for Data and Power", IEEE, 1997, pp. 52-55.

* cited by examiner

ELECTRICAL GARMENT AND ELECTRICAL GARMENT AND ARTICLE ASSEMBLIES

TECHNICAL FIELD

The present invention relates to garments and garment technologies, and more particularly, some embodiments relate to electrical or other electromagnetic communications in garments.

DESCRIPTION OF THE RELATED ART

Electronic devices have become a ubiquitous and pervasive part of our contemporary milieu. This phenomenon has been catalyzed by advances in electronics and battery technologies, which have led to the viability of lower-power, feature rich, compact and lightweight portable electronic devices. For example, cellular telephones, PDAs, digital media players and portable gaming apparatuses, to name a few, are not only commonplace, but have become de rigueur accessories of our contemporary lifestyles. This phenomenon is not only readily observable in our day-to-day lives, but is further evidenced by the many commercial efforts to better integrate such electronic devices into our clothing and other accessories.

The uses of portable electronic devices are not confined to casual or recreational uses such as is often the case with media players and gaming apparatuses. In fact, portable electronic devices are a common and indeed necessary accoutrement in many commercial and professional settings and also enjoy widespread uses in various military and medical applications. For example, in medical applications, the use of monitoring devices or other sensors for telemetry monitoring of a patient's health, vital signs or other symptoms has become commonplace. As another example, military personnel are increasingly becoming more "wired" as they are outfitted with not only communication devices but also computers or computing systems, GPS receivers, head mounted displays (HMD) and other electronic accessories. In addition, some sports such as fencing, use electronic "touch" sensors worn in a jacket to signal a score. Because attaching these devices directly to the body can be uncomfortable or impractical, and because it is not always possible or practical to carry these devices with one's hands, it has become increasingly desirable to allow these electronic devices to be fitted to the wearer's garments. Because it may be desirable for a plurality of electronic devices carried by a user to communicate with one another, or to be connected to a separately housed power supply, electrical interconnects have become an increasing consideration for these devices.

For example, U.S. Pat. No. 6,324,053 is a patent directed toward a wearable data processing system and apparel, that purportedly provides a system and method for electrical interconnection of devices included in a wearable computer, so that a light cable network can be deployed that does not limit the body movements of the human being. As another example, U.S. Pat. No. 6,381,482 is directed toward a fabric or garment with integrated flexible information infrastructure that purportedly includes a fabric in the form of a woven or needed garment that includes a flexible information infrastructure integrated with in the fabric for collecting, processing, transmitting and receiving information.

Other technologies that are somewhat related include technologies for providing electrically conductive textile materials. For example, U.S. Pat. No. 4,975,317 is a patent directed toward electrically conductive textile materials and method for making the same. According to this patent, fabrics are made of electrically conductive by covering the fibers of the fabric with an ordered conductive film. As another example, U.S. Pat. No. 6,080,690 is directed toward a textile fabric with an integrated sensing device and clothing fabricated thereof. This patent is purportedly directed toward a textile fabric that includes a plurality of electrically conductive fibers and at least one electronic sensor, or a plurality of sensing fibers. As yet another example, U.S. Pat. No. 6,727,197, titled "Wearable Transmission Device" is purportedly directed toward a knitted, woven, or braided textile ribbon that includes fibers and one or more transmission elements running the length of the ribbon in the place of the one or more fibers.

BRIEF SUMMARY OF EMBODIMENTS OF THE INVENTION

According to various embodiments of the invention, electrical garments and components thereof are provided. For example, in some embodiments, a communication medium is integrated into a garment seam that is used to join two or more portions of a garment. The communication media can be used to provide electrical or other electromagnetic connection for coupling among a plurality of electrical devices associated with the garment. Accordingly, the electrical garment can be configured for a plurality of uses, applications and environments, depending on the electrical devices associated therewith. The electrical devices can be configured to be attached to or integrated with the garment in a releasable fashion or in a more permanent configuration. The electrical devices can be chosen for their desired functionality and interconnected with the communication media, which is at least partially integrated within the garment seams.

The garment seams in which the communication media can be integrated can include seams used to connect to separate garment panels together can be the seams used as a cuff or hem, or can be seams provided solely for the purpose of providing confinement for the communication media.

The electrical garment can be used for a number of applications, ranging from, for example, personal recreational or entertainment purposes to professional, military, or medical applications. Accordingly, electrical devices used with the electrical garment can include, for example, radios or other wireless communication devices, PDAs, portable computing devices, GPS devices, sensors, media players, and various other electrical devices. Electrical devices might also include solar cells or arrays, batteries, fuel cells, or other devices to provide power to electrical devices or other equipment.

The communication media can include any of a variety of different communication media such as, for example, insulated solid or stranded wires; coaxial, triaxial or other X-axial cabling; fiber-optic cabling; twisted pair wiring; ribbon cable; and flexible PCBs; to name a few. The dimensions and form factor of the communication media can be chosen with comfort and aesthetics in mind. For example, the width of the communication media might be chosen so as to allow the integration thereof into seams that do not exceed a predetermined width, such as a width chosen for aesthetic reasons. As another example, a depth or thickness of the communication medium might be chosen so that the seams do not appear too bulky to an observer of the garment, or such that they do not create discomfort to the wearer.

Additionally, in some embodiments it is desirable that the communication media be sufficiently flexible such that it does not adversely affect the drape or wearability of the garment. With this consideration in mind, and realizing that many portions of the garment are typically required to have some flex or freedom of movement, it is also desirable in some embodiments that the communication media be sufficiently flexible to allow such freedom of movement without creating undue risk of damage to or breakage of the communication media.

An additional embodiment provides an electrical connector comprising a first electrical connector element having a housing and at least one contact element, with the contract element configured to provide electrical connectivity when joined with a second connector element also having a housing. However, in the second connector element the housing also contains a ball cage with multiple balls, an o-ring, and a contact element configured to provide electrical connectivity between the first and second connector elements. The ball cage and o-ring joining system permits press joining of the two connector elements and also provides a secure electrical connection.

Another embodiment provides an electrical garment, comprising a plurality of textile portions; fastening elements configured to join the plurality of textile portions to create the garment, the fastening elements creating a seam at the junction of two or more of the textile portions; communication media disposed within the seam and configured to provide electromagnetic connectivity between a plurality of electrical devices; and electrical connectors for providing electromagnetic connectivity between the seam and an additional textile portion.

A further embodiment provides an electrical garment comprised of a plurality of textile portions with fastening elements that are configured to join multiple garment portions to create the garment. The fastening elements create a seam at the junction of two or more textile portions. Communication media, such as electronic wires and the like, are disposed within the seam and configured to provide electromagnetic connectivity between multiple electrical devices. In addition, electrical connectors are provided for obtaining electromagnetic connectivity between the seam and an additional textile portion. The additional textile portion may also be an accessory item such as a pouch or hood with a variety of electronic devices contained within. These devices may include, for example, entertainment devices or devices for casual, professional, medical or military use. For example, devices can include electronic music players, such as an MP3 and similar devices, a GPS or other like units, sensor packages, communications equipment, monitoring equipment and so on.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

According to various embodiments of the invention, electrical garments and components thereof are provided. For example, in some embodiments, a communication medium is integrated into a garment seam that is used to join two or more portions of a garment. The communication media can be used to provide electrical or other electromagnetic connection for coupling among a plurality of electrical devices associated with the garment. Accordingly, the electrical garment can be configured for a plurality of uses, applications and environments, depending on the electrical devices associated therewith.

The garment seams in which the communication media can be incorporated can include seams used to connect to separate garment panels together or the seams may be used as a cuff or hem, or can be seams provided solely for the purpose of providing confinement for the communication media. FIG. 1A-1G illustrate seams used to connect separate garment panels together or used to create routing of various forms of communications medium for various applications including military, sports and leisure.

Figure 1A:
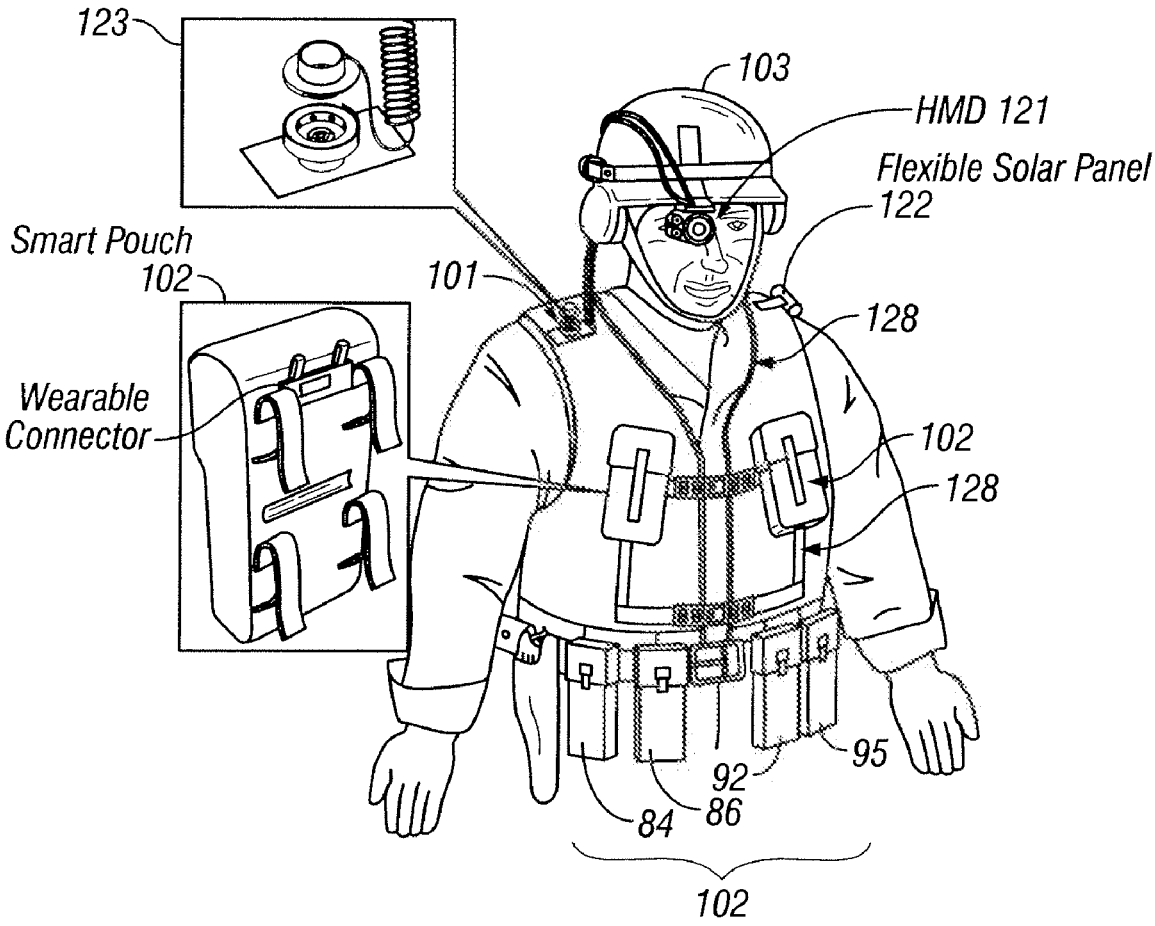
FIG. 1A is a diagram illustrating an example of military garment(s) with which the technologies described herein can be implemented.

The electrical devices can be configured to be attached to or integrated with the garment in a releasable fashion or in a more permanent configuration. The electrical devices can be chosen for their desired functionality and interconnected with the communication media, which is at least partially integrated within the garment seams. A variety of electrical connectors can be used to allow electrical devices to be connected to the electrical garment. For example, in some embodiments, connectors can be integrated with garment fasteners such as snap fasteners, rivets, and other fasteners to further allow the integration of the electrical features of the garment with the garment itself, as illustrated in FIG. 1A. This is illustrated by the "smart pouch" 102 in FIG. 1A which attaches and forms an electrical connection when snapped into place. Electrical connections may also be formed in the seams of the vest illustrated in FIG. 1A.

Before describing the invention in full detail, it is useful to describe a few example environments with which the invention can be implemented. One such example is that of a military garment or garment set such as for example, a military vest, shell, pack or pouch. Another example is a medical garment for use within our outside of a hospital, hospice or other treatment facility. Yet another example is that of formal, business or casual attire. Still another example is sports attire. FIG. 1A is a diagram illustrating the first example of a military garment with which the technologies described herein can be implemented. Referring now to FIG. 1A, the illustrated example is that of a tactical military vest 101, that includes smart pouches 102 electrical connectors 123 and seams 128 that are configured as a conduit for various forms of communication medium such as wires, cables and the like. As this example further illustrates, connector 123 can be used to provide electrical connectivity to various devices such as, for example, a helmet mounted display (HMD) 121, a flexible solar panel 122, and one or more smart pouches 102. In addition to hardwired interface as, a wireless interface can be provided such that devices or equipment attached to the vest can communicate wirelessly with devices such as the helmet-mounted display 121, communications gear in the helmet 103, devices or equipment in a backpack or other remote devices.

Although not depicted in FIG. 1A, the garment can include additional electrical or electronic devices such as, for example, portable computing devices, radios or other communication equipment, GPS or other positioning systems, sensors, or any of a variety of other electronic devices. These electronic devices can be fixedly or removably integrated with the garment. For example, these devices might be mounted to the garment in it detachable fashion such as, for example, through the use of hook-and-loop fasteners, snap fasteners or other releasable physical connections. As another example, these devices might be disposed in a pouch or other pocket of the garment such as a smart pouch 102 or a smart pocket or other insert. As yet a further example, these devices might be sewn into the garment.

These garment and devices can use wearable connectors 123 to facilitate electrical connectivity and mechanical fastening to the garment. Although one form of wearable connector 123 is shown in FIG. 1A, any of a variety of wearable connectors can be utilized depending on the application and environment. Examples of such connectors can include those described in this document. Other examples include those described in United States Patent Application Publication No. 2007/0105404, Electrical Connector Configured as a Fastening Element, to Lee, et al., and in U.S. Pat. No. 7,335,067 to Lee et al.

In this and other environments, it may be desirable to provide for electrical or other electromagnetic interconnections between or among the electronic devices associated with the one or more electrical garments. Accordingly, wired or wireless communication interfaces may be provided so that the devices can communicate with one another. Additionally, electrical interfaces can be provided for provisioning power to the one or more electrical devices. For example, the interfaces can supply different voltages to different devices as might be required by such devices.

In another embodiment, the electrical garment might be configured as a wearable computer or computing device. For example, consider the military vest depicted in FIG. 1A. this vest is illustrated as having a plurality of smart pouches 102 attached thereto. Smart pouches 102 can be configured to hold a plurality of devices used to make up a computing system such as, for example, a processor 84 a graphics card 86 memory or disk drive 92 and a power source 95. Seams 128 with integrated communication medium 132 (illustrated in FIGS. 4-6) can be utilized to provide interconnections between these and other components for the computing system. For example, a helmet-mounted display 121 might be configured as a display device for the computing system. Accordingly, helmet-mounted display 121 can be interfaced to the computing system via communication media 132. Connectors such as, for example, smart connectors 123 can be utilized as I/O ports for the computing device. As this example illustrates, other peripherals or elements of the computing system can be interfaced utilizing, for example, communication medium 132 integrated into seams 128. As with the other embodiments, other indications interface, whether wired or wireless, can also be utilized. Accordingly, in one embodiment, the vest and associated devices can be configured to function as a distributed wearable computer.

In another embodiment, connectors 123 or other connectors on the garment can be utilized to connect to the human body. Accordingly, the garment can be configured to serve as a health-care garment for administering healthcare or monitoring the status of a patient. For example, smart pouches 102 might be configured to contain monitoring and communications equipment to monitor the status of the patient, correlate information, and to communicate telemetry data regarding the patient to a hospital or other healthcare facility or provider. As another example, smart pouches 102 can be configured to contain equipment to control the infusion of medication to a patient or to control medical devices implanted within the patient. Further to this example, devices might be provided with the electrical garment to monitor patient vital signs and to communicate control information to medical devices such as, for example, an implanted pacemaker. Accordingly, devices installed on or in the garment can monitor the status and condition of the patient and control the patient's pacemaker in accordance with the monitored information. Status or other telemetry information can be communicated to the appropriate healthcare providers. As yet another example, the garment can be configured to contain a medication infusion device such as, for example, an insulin pump. Again, the garment can be configured to include equipment to monitor status of the patient and administer the medication accordingly, or to administer medication on a scheduled dosing basis.

In the examples illustrated in FIGS. 1A-1G electrical interconnections 128 are illustrated as being integrated with or into textile seams in the wearable vest 101. In this example, the electrical interconnections 128 can include communication media 132 (illustrated in FIGS. 4-6) such as copper wire, twisted pair, coaxial cable, optical fiber and micro coaxial cable as examples. As would be apparent to one of ordinary skill in the art after reading this description, various forms of electrical, electronic or other electromagnetic communication interfaces can be provided. Accordingly, communicative seams can be provided with one or more electrical garments to provide interconnections among the various electronic devices.

Figure 1B:
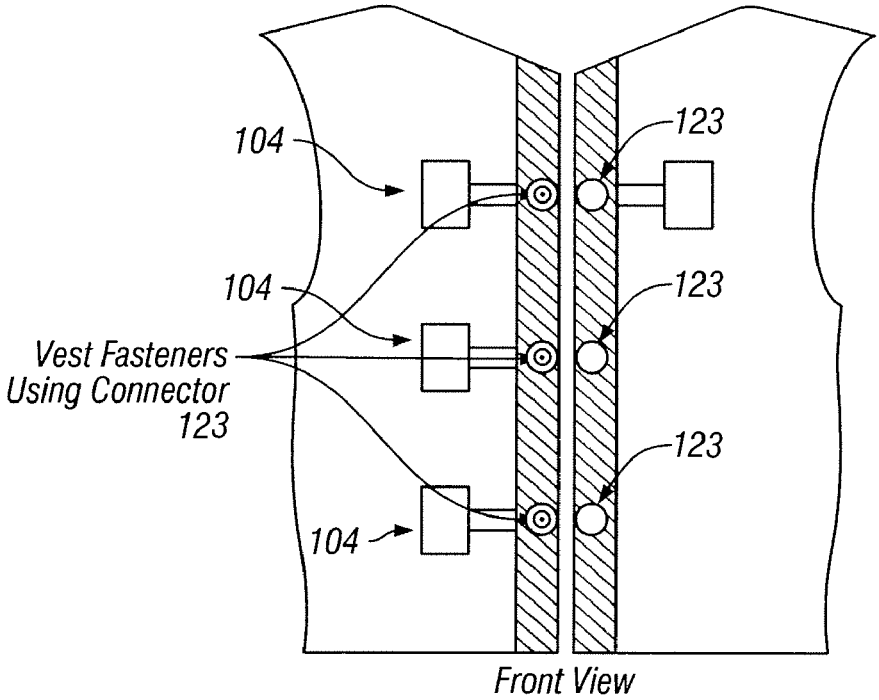
FIG. 1B is a diagram illustrating a vest incorporating electronic wiring into a seam and electrical connectors as closure devices in accordance with embodiments described herein.

Additional electrical interfaces may be provided by incorporating electrical connectors 123 into the electrical garment assembly. These electrical connectors 123 may be used to facilitate attachment and removal of electrical devices such as, for example, the smart pouch 102 and helmet-mounted display 121 with the garment (examples of which are shown in FIG. 1A). The electrical connectors may also be used to close electrical connections once the garment is donned as shown in FIG. 1B. One example might include using wearable connectors 123 to allow fastening of textile or garment portions together. For example, rivetable snap connectors such as those described below can be used to allow mechanical closure of a jacket or vest front while at the same time providing electrical connectivity of the garment portions being joined.

One example of using rivetable snap connectors is illustrated in FIG. 1B. Referring now to FIG. 1B, in this example, three rivetable snap connectors 123 are illustrated as being provided to allow closure of the front portion of the vest, while also providing electrical connectivity. Wiring, cabling or other electrical or electromagnetic communication medium can be included to provide electrical connectivity among a plurality of devices 104. The communication medium can be, for example, within seams and can connect devices 104 to connectors 123, can interconnect connectors 123 or otherwise be routed for the desired architectural configuration. Additionally, connectors 123 can be used to provide additional electrical connectivity among devices 104 across both garment portions when the connectors are closed.

Figure 1C:
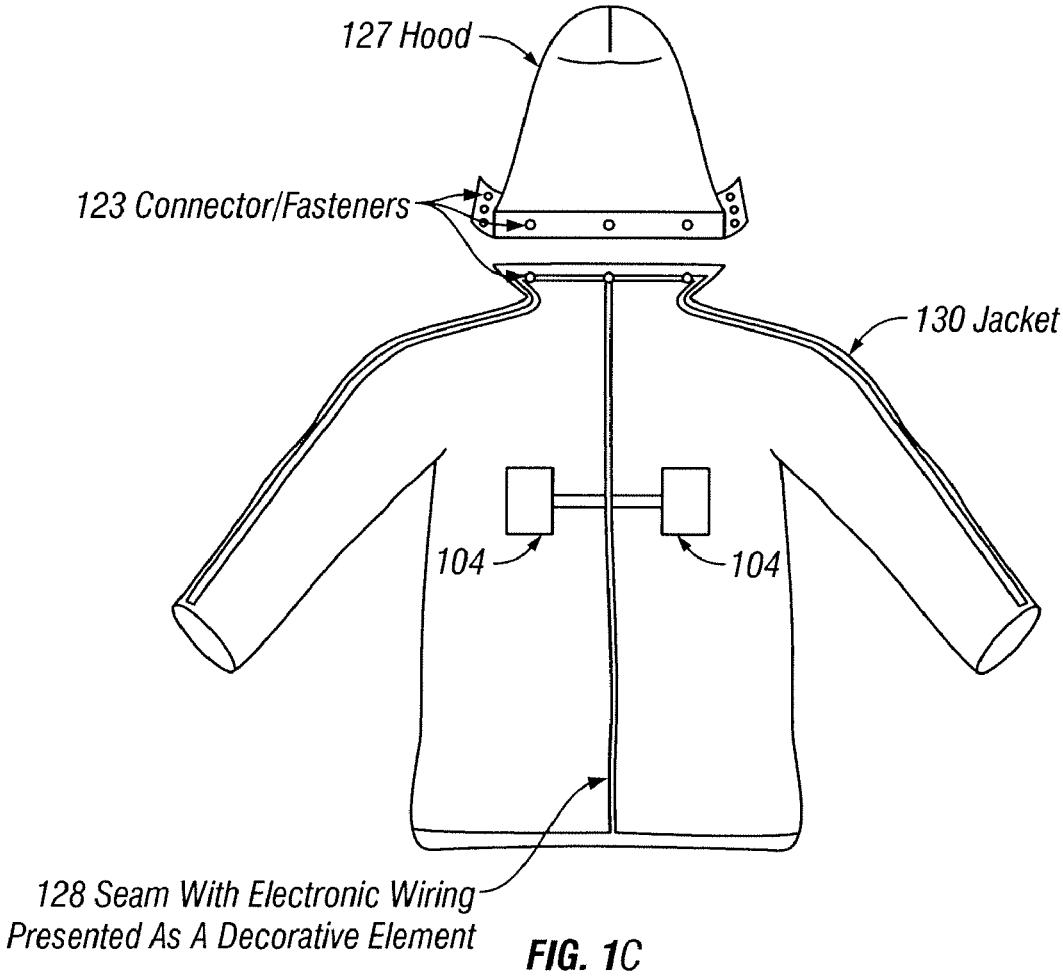
FIG. 1C is an illustration of examples of tailoring an electrical garment in accordance with embodiments described herein.

A further example such as shown in FIG. 1C may be attaching a hood 127 to an outer garment for winter activities using the connectors 123 also shown in FIG. 1B. Such connectors can be used to facilitate connectivity to devices in the hood 127 such as, for example, portable music devices, GPS devices, heaters, or emergency locator beacons. Likewise, gloves, outer shells and other garments and garment accessories can be attached with electrical connectors/fasteners 123 to facilitate mechanical and electrical connectivity among garments. One of ordinary skill in the art after reading this will appreciate that this technology can be used for other applications and personnel, such as for example, health-care professionals, emergency workers, engineering technicians and so on. Other examples might include clothing worn by fishermen, photographers, cowboys or other outdoors persons who wear multi-function or functional garments. In each of these examples, the desirability of integrating electronic devices of various forms can be accomplished by providing garments with integrated communications connectivity and electrical/mechanical connectors.

Figure 1D:
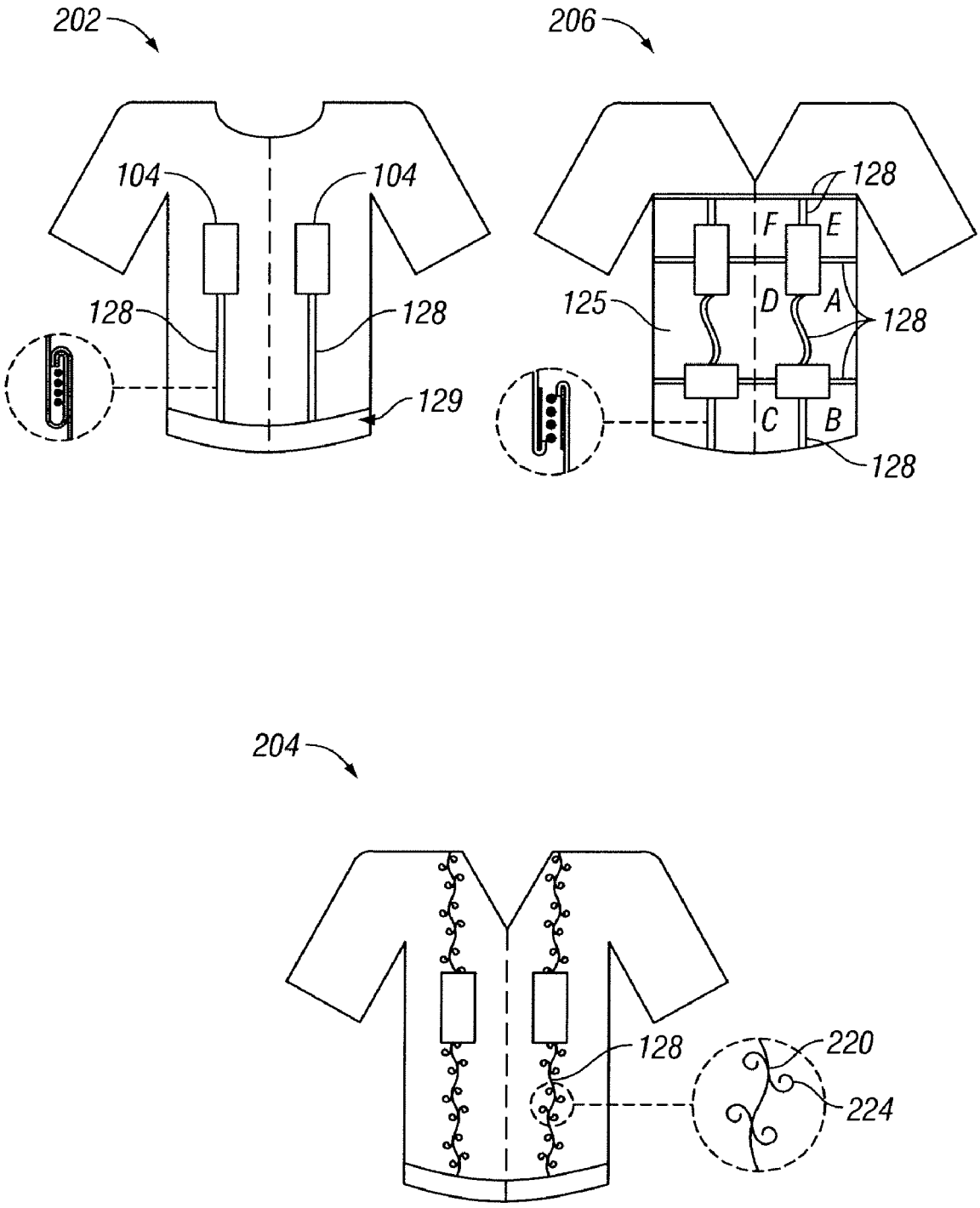
FIGS. 1D and 1E are diagrams illustrating examples where an electrical garment is tailored with functional and aesthetic considerations in mind.

FIG. 1D is a diagram illustrating examples of electrical garment tailoring that can be used to enable functional aspects of the garment to be integrated with appearance aspects of the garment. For example, garment 202 illustrates a relatively simple embodiment wherein integrated seams 128 are included to provide connectivity to two devices 104. Although a straightforward implementation is illustrated with two seams (one for each device 104) used to connect the devices, the seams can be applied in a decorative manner to provide a fashionable appearance to the garment 202. The example of garment 204 shows a decorative stitching used to provide the electrical connectivity to devices 104. In particular, the example illustrates a primary seam 220 that takes a meandering path along the garment and secondary stitching 224 to provide a more decorative look. In one embodiment, the communication medium can be integrated into primary seam 220 so that electrical conductors do not have to be forced to fit along a more tortuous route. Accordingly, this example illustrates that a primary seam with integrated electrical connectivity can be combined with additional decorative stitching to provide decorative effects and to camouflage the electrical communication path. In this and other embodiments, camouflaging communication medium 132 and hiding other electronic devices can enable creation of a garment for clandestine operations. With the use of miniaturized electrical or electronic devices hidden in pockets or in a liner of the garment, and camouflaged vacation paths between the devices, the electrical garment with its enhanced capabilities can be made to appear as an ordinary, everyday garment.

The garment illustrated at 206 shows an example of designing the garment panels in accordance with the electrical connectivity paths desired. In this example, four electrical devices 104 are shown as being interconnected by communication media integrated in seams 128. Also in this example, the garment is designed with multiple panels (A-F illustrated) connected together with seams 128. Alternatively, separate panels need not be used, but seams can be added to merely give the appearance of multiple panels. These simple examples serve to illustrate that the design of the garment from a fashion perspective can be undertaken with the electrical connectivity requirements and specifications in mind, much in the way that an architect designs the appearance of a building with functional requirements and specification in mind.

Figure 1E:
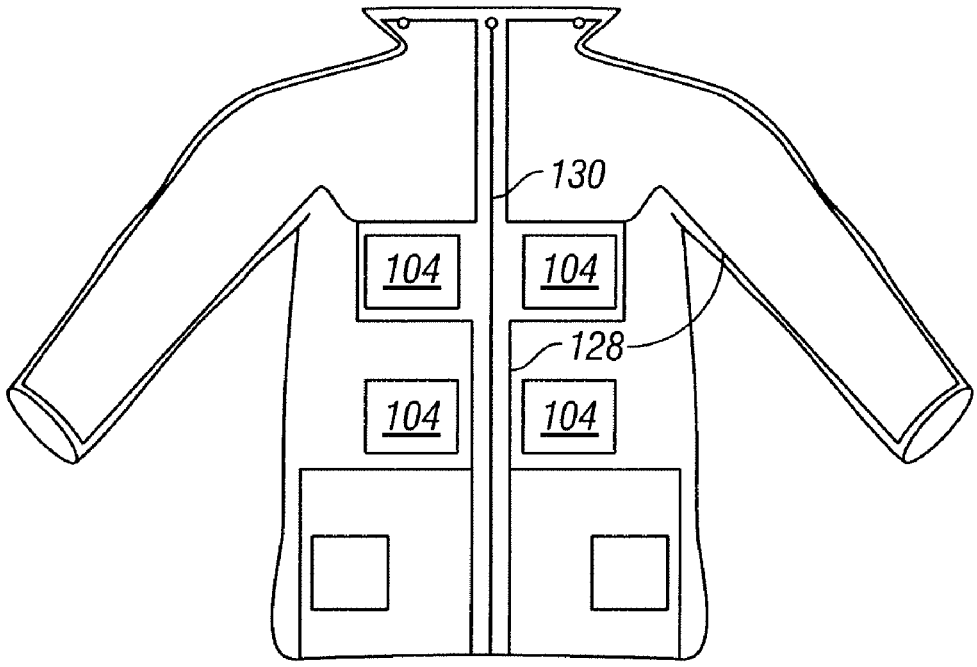

FIG. 1E illustrates yet another example of providing electrical connectivity using wire or other communication links embedded in seams 128 in a manner that accounts for both functional and aesthetic considerations. In the illustrated example, four devices 104 are shown as attached to the garment with wired seams 128 running therebetween in a decorative manner.

Figure 1F:
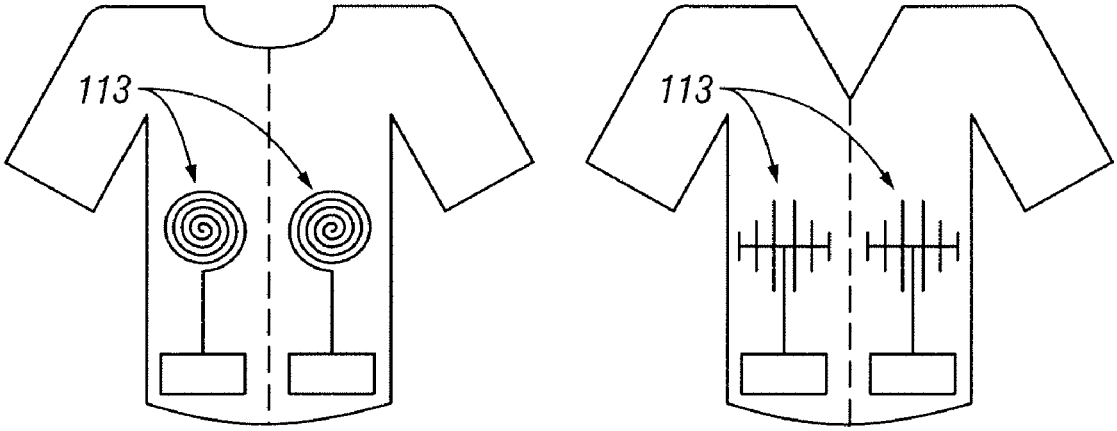
FIG. 1F is a diagram illustrating examples of electrical conductors integrated in garment seams and routed to form antenna patterns.

FIG. 1F is a diagram illustrating examples of how electrical communication paths 128 can be used to fulfill functional requirements of an antenna. In the example illustrated in FIG. 1F, antenna 111 is an example of a phased-array antenna. As shown, multiple antenna elements can be fashioned using wires integrated with seams 128 to form elements of a phased array antenna. The multiple elements behave as multiple active antennas that are coupled together and controlled produce a directive radiation pattern. As another example, a spiral antenna 113 is shown as being formed using conductive element integrated in a textile seam 128 in a spiral pattern. Lengths of antenna elements can be selected so as to properly tune the antenna for given frequencies and operating conditions. Tuning, matching and other adjustment networks (not illustrated) can be included with the garment such as, for example, in smart pockets, pouches or otherwise.

As these examples illustrate, a number of patterns can be used to provide functional capabilities in an aesthetic manner. In addition to the spiral or phased-array patterns illustrated in these examples, other antenna patterns can be made integrated into the garment. In yet another embodiment, a pattern of wires can be utilized to provide an electronic signature to the garment. For example, unique patterns of wires and unique signaling in the wires can be utilized to provide an electronic signature. Accordingly, reception or detection equipment can be used to positively identify the garment. This can be used to identify or authenticate the garment or the individual wearing the garment and can be used for anti-counterfeiting or anti-terrorist measures. It should be noted that where wires or other communication media 132 are utilized to form antenna elements or other radiative or receptive elements, it may be desirable to ensure that these elements are positioned outside of any EMI fabric (see below) that may be provided in the seam. This can help to avoid any losses that might be caused by such shielding.

In yet another embodiment, wires can be integrated into the garment and configured as resistive heating elements to provide heat to the wearer. The seams can be arranged in a pattern so as to distribute the heat in an appropriate manner. Additionally, materials with a high specific heat or heat capacity can be utilized within the seams to help hold be generated heat longer as well as distribute the heat in a more even fashion. Although they may take longer to heat up, materials with a high specific heat can allow the garment to retain heat longer.

In yet another embodiment, seams with integrated communication medium 132 can be arranged so as to provide a pattern for camouflage or obfuscation of the garment. Likewise, a pattern of wires can be arranged so as to provide anti-tampering for the garment or elements of the garment such as pouches or pockets. For example, a pattern of wires can be arranged in a pattern surrounding an area to be protected and the pattern connected to sensing circuitry to detect tampering such as by checking for changes in resistance in the pattern and the like.

Figure 1G:
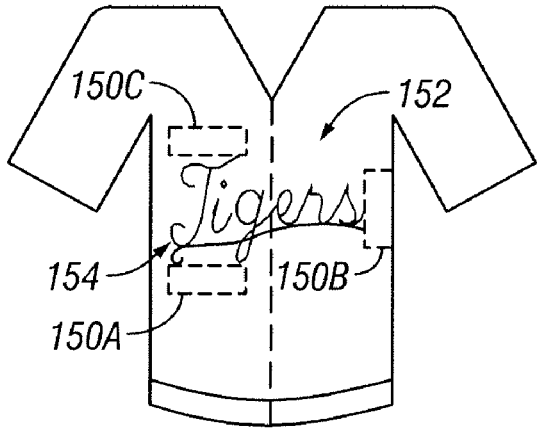
FIG. 1G is a diagram illustrating an example of arranging a communication medium behind a logo or in seams used to create a logo.

In still further embodiments, communication medium 132 can be arranged in patterns to form words or logos. FIG. 1G is a diagram illustrating an example of arranging communication medium 132 behind a logo or in seams used to create a logo. As shown in this example, the underlined, stylized logo "Tigers" is provided on the front of a garment. The example also shows three pockets 150 that can be used to house electrical or electronic equipment or devices. Dashed lines are used to illustrate this, as these pockets 150 can be provided on the inner side of the garment so that they are not visible on the exterior of the garment. As this example illustrates, the logo 152 includes letters to spell out the word "Tigers" as well as an underline 154. In this example, communication medium 132 can be disposed behind the logo and can run between the various devices 150. For example, communication media 132 can run behind underline 154 from device 150A to device 150B. Likewise, communication media 132 can run behind the "T" in "Tigers" and to device 150C. In a further embodiment, additional seams 128 can be provided such that communication medium 132 can be run among devices 150 were to other devices elsewhere on the garment.

With these concepts in mind, electrical garments with a high degree of electrical or electronic functionality can be provided with a functional design that is comfortable, functional, aesthetically pleasing and ergonomically sound. For example, electronic devices can be positioned in such a way to enhance comfort and usability; electrical connectivity to and among such devices can be accomplished in a manner that is functionally appropriate, aesthetically pleasing and comfortable; and electrical connectors can be used to provide releasable closures that also provide electrical connectivity.

From time-to-time, the present invention is described herein in terms of these example environments and applications. Description in terms of these environments is provided to allow the various features and embodiments of the invention to be portrayed in the context of an exemplary application. After reading this description, it will become apparent to one of ordinary skill in the art how the invention can be implemented in different and alternative environments.

The present disclosure is directed toward systems, methods and apparatus is related to the garments, and more particularly electrical garments. Certain embodiments are directed toward systems, methods, and apparatuses for the interconnection of electrical devices used with an electrical garment. For example, some embodiments, electrical or electromagnetic communications media such as fibers, wires, harnesses, cables, or network infrastructure elements can be integrated into a garment to allow devices associated with that garment to be connected thereto.

Figure 2:
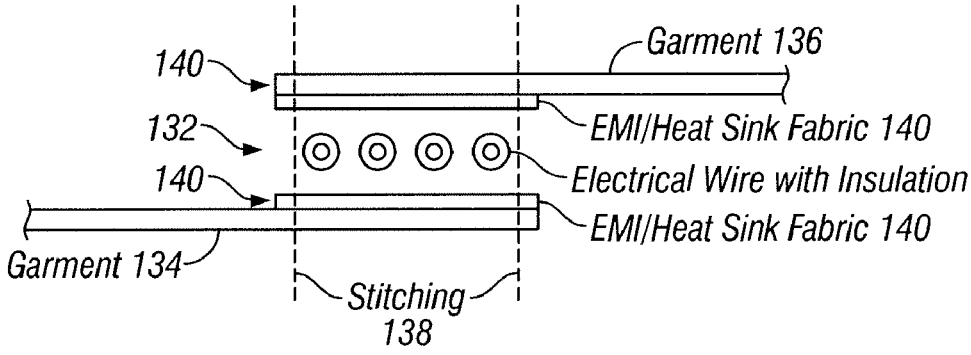
FIG. 2 is a diagram illustrating a first example of integrating a communication media into a garment in accordance with one embodiment of the technologies described herein.

There are a number of ways in which the communication media can be integrated into the electrical garment. FIG. 2 is a diagram illustrating a first example of integrating a communication media into a garment in accordance with one embodiment of the invention. Referring now to FIG. 2, this example illustrates a communication media 132 integrated between two garment portions 134, 136. In the illustrated example, communication media 132 are illustrated as electrical wire with insulation, although other communication media 132 can be utilized. Garment portions 134, 136 can be portions of the same garment panel, or separate garment panels joined by stitching or other fastening elements. Garment panels might include, for example, a garment front, back, sleeve, cuff, pocket or other panel used to form a section of the garment. Garment portions 134, 136 are joined together by fastening elements such as stitching 138. This is illustrated by dashed lines running vertically through the cross-sectional view. In this illustrated example, each of the elements in the communication media 132 are enclosed by boundaries created by garment portions 134, 136 and stitching 138.

Also illustrated in FIG. 2 is additional material 140 that can be provided on either or both sides of communication media 132. This additional material 140 can be selected so as to provide additional features or capabilities to the seam incorporating electronic wiring. For example, additional material 140 might be material configured to shield against electromagnetic interference (EMI), or fabric or other material with the ability to conduct heat to act as a heat sink for an attached electronic device. As another example, additional material 140 might include material that can be used to provide temperature control to the garment wearer such as, for example, resistive heating elements or elements operating in accordance with the Peltier effect that can be used to provide heating or cooling through the application of electrical current. As still another example, antennas can be implemented in the seam incorporating electronic wiring either as part of the communication media 132 itself or as additional material 140.

Figure 3:
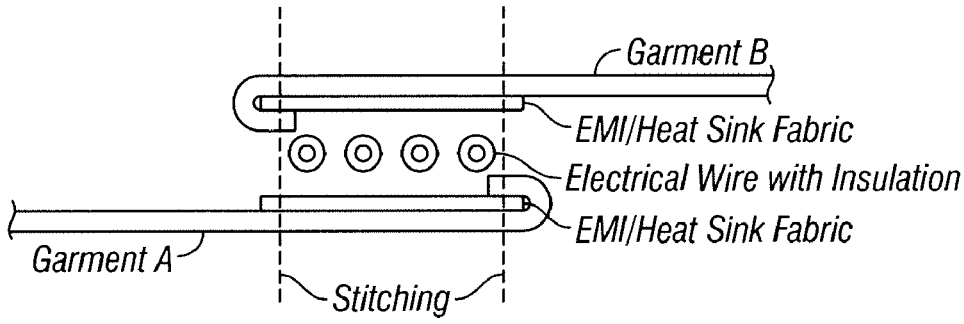
FIG. 3 is a diagram illustrating another example of a seam incorporating electronic wiring in accordance with one embodiment of the technologies described herein.

FIG. 3 is a diagram illustrating another example of a seam incorporating electronic wiring in accordance with one embodiment of the invention. Referring now to FIG. 3, this seam is similar to that discussed above with reference to FIG. 2, however, in this embodiment, garment portions 134, 136 are configured to extend beyond the extent of additional material 140 at their outer edges. In this example, the outer edges of garment portions 134, 136 not only extend beyond additional material 140, but are also wrapped back over at least one edge of the additional material 140 and stitched together by stitching 138.

Figure 4:
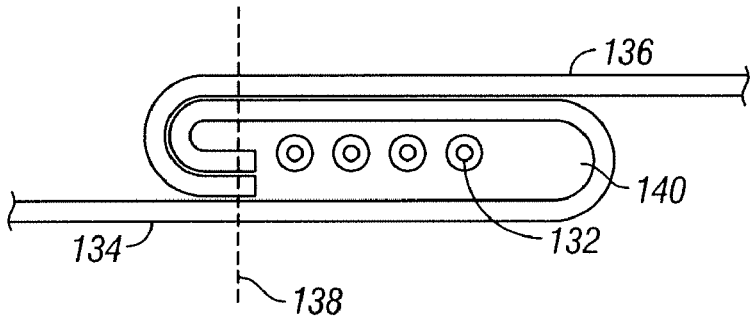
FIG. 4 is a diagram illustrating yet another example in accordance with another embodiment of the technologies described herein.

FIG. 4 is a diagram illustrating yet another example of a seam incorporating electronic wiring in accordance with another embodiment of the invention. Referring now to FIG. 4, in this illustrated example, garment portion 134 is configured to wrap completely or almost completely around communication media 132 and to be joined with garment portion 136 and stitched by a set of stitching 138 on one edge of the seam. Additional stitching at the other edge of the seam (not illustrated) can be included as well. As with the other embodiments, an EMI or heat shield, or other additional material 140 can be included as well. In the illustrated example, additional material 140 is illustrated as a single sheet that is also wrapped around communication media 140 and secured by stitch 138.

Figure 5:
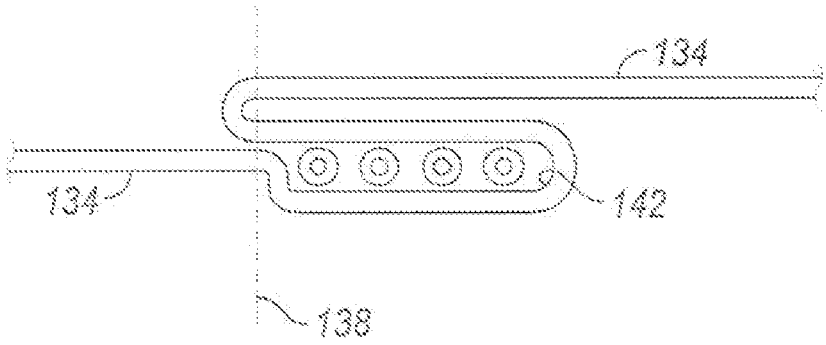
FIG. 5 is a diagram illustrating a further example of a seam incorporating electronic wiring in accordance with an embodiment of the technologies described herein.

FIG. 5 is a diagram illustrating a further example of a seam incorporating electronic wiring in accordance with an embodiment of the invention. In the illustrated example, the seam is configured by joining the same garment portion 134 to itself by a stitch 138 forming a pocket 142. Accordingly, the seam can be configured as a hem of the garment. EMI shielding, heat shielding, or other additional material 140 can be included in this embodiment as well. Although a single set of stitching 138 is illustrated in FIG. 5, additional lines of stitching (not illustrated) can be provided such as, for example, on the opposite side of the seam or hem if desired. FIG. 5 also illustrates how a seam may be created from a tailoring point of view to add aesthetic interest to an electrical garment.

Figure 6:
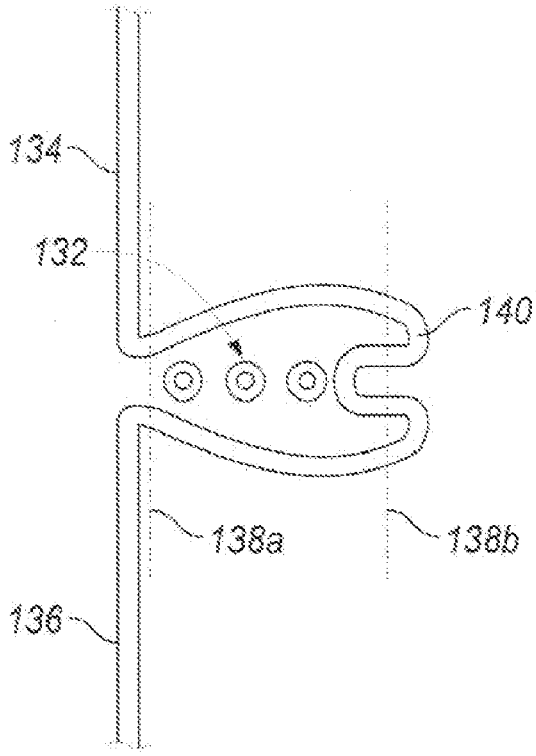
FIG. 6 is a diagram illustrating yet another example of a seam incorporating electronic wiring in accordance with an embodiment of the technologies described herein.

FIG. 6 is a diagram illustrating yet another example of a seam incorporating electronic wiring in accordance with an embodiment of the invention. In this example, two garment portions 134, 136 are joined together using two stitches 138. As shown, a first set of stitches 138*a* joins garment portions 134, 136 at the proximal end of the seam near the garment. Likewise, a second set of stitches 138*b* joins garment portions 134, 136 at the distal end of the seam at a location farther from the garment. In the illustrated example, garment portions 134, 136 are joined at the distal end in a wrapped fashion with the distal end of each garment portion 134, 136 being wrapped over upon itself in the area of stitching 138*b*. In another embodiment, the distal ends of garment portions 134, 136 are not wrapped over upon themselves but simply laid flat against one another for stitching. Also illustrated in the example in FIG. 6 is an example configuration for additional material 140 that can be included with the seam incorporating electronic wiring. In the illustrated embodiment, the additional material 140 is shown as a single sheet of material that is folded upon itself and stitched at both ends by stitches 138*a*, 138*b*.

As these examples illustrate, in some embodiments, a seam incorporating electronic wiring can be provided such that it incorporates a plurality of features useful for an electrical garment such as, for example, the physical or mechanical connection of garment portions, electromagnetic connection for one or more electronic devices, heat dissipation or management, and EMI shielding. As these examples further illustrate, integrating a communication media into seams can also serve to help protect and route the communication media. For example, the garment portions 134, 136 surrounding the wire or other communication elements 132 can in of itself serve to protect these elements. Additionally, although not illustrated, additional materials can be provided to help strengthen or better protect the communication media 132 embedded into seams. Accordingly, the seams can, in some embodiments, be thought of as conduit used to facilitate placement and routing as well as protection of the wires or other medication elements.

In various embodiments, the electrical garment can be configured and designed to combine functionality with aesthetics. For example, the electrical garment "tailor" can be analogized to an architect of a building in that each will strive to integrate functionality and performance into a design that is aesthetically pleasing. For example, attachment points for electronic devices can be chosen in such a way that electrical connections through naturally placed garment seams can be accomplished with few or no additional seams being added merely for the purpose of electrical connection as illustrated in FIG. 1B. As another example, attachment points for electronic devices can be chosen in such a way that any seams that might be desirable to add for electrical connection can be added in a place or manner so that they are aesthetically pleasing. For example, the devices might be configured to be attached in a way that the seams can be hidden from view or in a way that seams can be added in a decorative manner appearing as, for example, adornment to the garment as illustrated in FIG. 1C.

In various embodiments, the electrical garment can be designed partially or completely "from scratch" with the electrical functionality in mind. In other embodiments, existing garments can be retrofitted to include electrical devices and electrical interconnects thereto. For example, attachment points for electrical devices can be added to existing garments and communication media 132 added to existing seams. Additionally, new seams can be added for areas where additional communication media 132 is required. Where communication media 132 is added to existing seams, in some instances depending on the seam configuration, communication media 132 can be threaded or fished through existing seams without having to remove or replace any stitching. In other instances, seam stitching may have to be removed and replaced to allow the integration of communication media 132 in existing seam.

As the above examples illustrate, communication media 132 can be added to seams in an existing garment design and additional seams can be provided as desirable. For example, seams, puckers, folds, pleats, darts, gussets, or other like structures that might otherwise exist in a garment design can be used as locations in which communications media 132 can be integrated.

Various connection points were connection mechanisms can be included with an electrical garment to allow for the integration of electrical devices as appropriate. For example, releasable and non-releasable attachment means can be included for attachment of various electrical devices. As one example, pouches, pockets, or other like structures can be sewn or otherwise integrated into a garment and configured to hold an appropriately sized electrical device. As another example, releasable attachment means such as, for example, snap fasteners, hook-and-loop fasteners, and other fastening means can be used to provide a releasable attachment of electronic devices to the garment. As yet another example, non-releasable attachment means can be used to more permanently affects an electronic device to the garment. For example, an electronic device can be permanently sewed glued or welded into the garment or could be attached by other non-releasable attachment means.

Various configurations of electrical connectors can be utilized to provide an electrical connection between the electrical devices and communication media 132. The electrical devices can be interconnected as desired for a given functionality. Interconnections can be made on a point-to-point basis, as a network, or in a daisy-chained fashion. For example, a "backbone" communication media can be provided for the interconnection of electrical devices. Examples of electrical connectors that can be used can include those described in U.S. Pat. Nos. 7,297,002 and 7,335,067 and Patent Application Publication Nos. US 2007/026695 and WO 2007/015786, all of which are incorporated by reference herein in their entirety.

As described in various embodiments herein, optical fibers, wires, or other communication media can be integrated into a wearable garment that can be used to provide electrical or electromagnetic connectivity between or among a plurality of electrical devices associated with the garment. In a simple embodiment, point-to-point wiring can be used to connect one or more electrical devices directly. While, as previously noted, in other embodiments daisy-chains as well as backbone or network topologies can be implemented to provide connection of the one or more electrical devices.

In some embodiments, the communication media 132 can be integrated with a garment in a manner so as to provide for flexible adaptability to a plurality of configurations of electrical devices allowing for a broad range of environments or applications. In other embodiments, a more custom approach can be taken to predefine the communication paths for a particular application or set of applications or for particular types or classes of devices. As one example, a garment might be created as a garment that has communication media 132 integrated at least partially within the seams so as to allow interconnectivity among a predefined set of devices or device types. As a further example, a garment might be created as a wearable computer that has communication media 132 integrated at least partially within the seams so as to allow interconnectivity among computing devices and peripherals. Carrying this example further, communication media 132 might be integrated so as to allow the garment to usably house a central processing unit, I/O devices and peripherals. Such communication media 132 can be laid out to allow these components to operate together as a wearable computing system. As this example serves to illustrate, the electrical garment can be preconfigured for a desired application and can be configured with some or all of the electrical devices pre-integrated into the garment or can be configured so as to allow for plug-and-play connectivity of electrical devices.

In some embodiments, relatively small form factor wiring, fibers, cabling or other communication media 132 can be used such that the seams do not appear bulky or bulging from an outward appearance and so that they do not present an uncomfortable profile to the wearer. For example, in one embodiment, ribbon cabling might be used, which presents a flat profile. Additionally, different types of communication media 132 can be used with a garment. For example, insulated copper wiring, twisted pair wiring, coaxial cabling, optical fiber and other electromagnetic communication media can be used as appropriate for the given application. As would be apparent to one of ordinary skill in the art after reading this description, other form factors and types of communication media 132 can be utilized to conform to seam widths, seam diameters or other dimensional factors associated with the electrical garment and the tailoring thereof. It should be noted that the use of the term "electromagnetic" herein is intended to cover not only signals in the conventionally described electromagnetic spectrum (3 Hz and above) but also electrical communication paths below 3 Hz including, for example, DC or non-time-varying signals.

As noted above, in some embodiments, EMI or RFI shielding can be included around the communication media 132 to provide appropriate shielding as may be desired for the signal levels, bandwidths, environment or applications. As one example, additional material can be a conductive material or fabric installed so as to partially or completely surround all or part of communication media 132 to provide EMI/RFI shielding. Examples of EMI/RFI materials can be used can include carbon fiber cloths, stainless steel or other conductive meshes, braided conductive wraps, conductive fabrics and so on. Examples of conductive fabrics that can be used for such purposes are conductive fabrics available from manufacturers such as Ferrishield, Inc. and Laird Technologies, among others. Other EMI or RFI shielding materials can also be used such as metallic braids etc., but conductive fabrics are preferable as they tend to exhibit a hand and flexibility that is more comparable to that of a garment fabric.

In the examples illustrated in FIGS. 1A, 1B and 1C and in the other Figures depicting example embodiments having additional material 140, the additional material 140 is illustrated as at least substantially surrounding communication media 132, or as being disposed on two sides of communication media 132. It will be apparent to one of ordinary skill in the art after reading this description additional material 140 might be disposed only on one side of communication media 132, or might be configured so as not to completely surround communication media 132. This alternative might not be a preferable alternative for applications such as EMI shielding. However, more additional material might be used as a heat shield or heatsink, as a means for protecting communication media 132 from physical damage, or for other purposes, such alternatives might be desirable.

Additionally, additional material 140 might extend beyond stitching 138 as illustrated in FIGS. 1A-1C and the other Figures in which it is pictured, or it might be contained partially or completely within the boundaries defined by stitching 138. In other words, the additional material might be positioned such that the stitching on either or both sides of the seam does not extend through the additional material.

Figure 7:
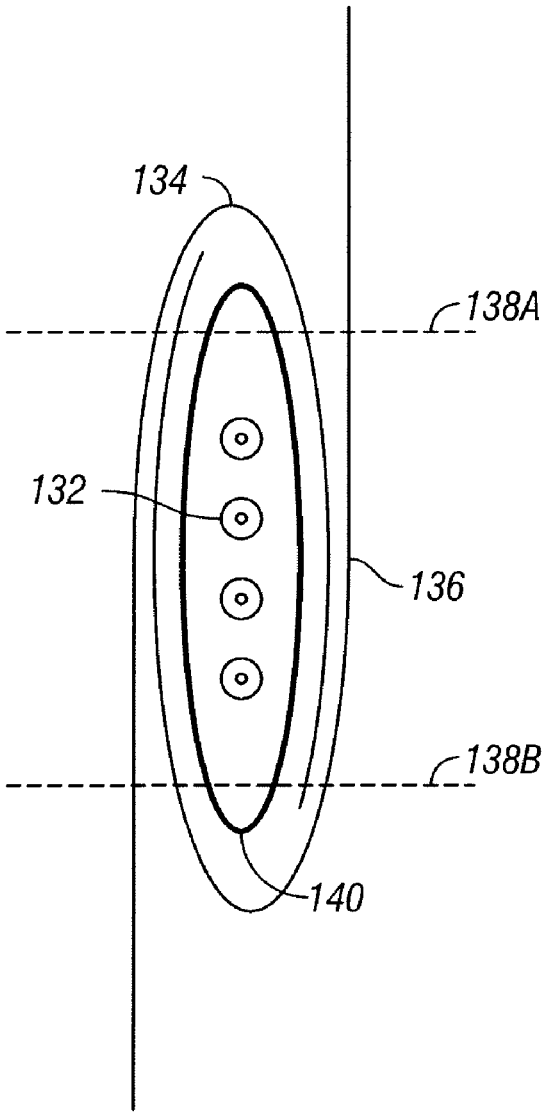
FIG. 7 is a diagram illustrating yet another example of a seam incorporating electronic wiring in accordance with an embodiment of the technologies described herein.

In yet other embodiments, additional material 140 might be cylindrical or tubular or the like, thereby surrounding all or part of communication media 132. FIG. 7 shows such construction. The communication media 132 is shown installed in tubular EMI/heat sink fabric 140. The communication media 132 and EMI/heat sink fabric 140 are shown configured in a seam composed of garment portions 134 and 136. Stitching 138*a* and 138*b* closes the seam. However in this configuration, the outer edges of additional material 140 may or may not be joined by stitching 138. It will be apparent to one of ordinary skill in the art after reading this description which of these or other configurations of additional material will be practical or useful depending on the communication media 132 being used, the bandwidth or frequencies communicated across communication media 132, the current levels, the environment in which the electrical garment may be used and conditions to which it might be exposed, the nature of the electrical devices being connected to the communication media 132 and so on.

It is noted that the stitches 138 are generally illustrated in the drawings herein as dashed lines. However, this form of illustration is made by way of example and not limitation. Indeed stitches 138 can be made by any of a number of different types of stitches or fastening elements used to secure garment portions, including various conventional garment stitches, including cross stitches, zigzag, blanket stitches, chain stitches, garter stitches, lock stitches, and so on. Additionally, other techniques for garment fastening can be utilized in place of or in addition to stitches. These alternatives might include, for example, welding, gluing, stapling or other garment fastening elements and techniques.

In some embodiments, conductive filaments or fibers can be used for the stitching to further facilitate the electrical properties of the garment. For example, the stitching itself can be used as a form of communication media between electronic devices. Likewise, the stitching can be used to form a ground plane, antenna, RFID tag, or other electrical device. Accordingly, in some embodiments, predetermined patterns of conductive stitching can be used to form some devices and can be connected to communication media 132 or connected directly to the electrical devices.

Additional flexibility in construction may be gained through the use of electrical connectors suitable for use in electrical garment assemblies. In some embodiments, further flexibility can be gained by using dual-function connectors such as connectors that can provide electrical conductivity of the electrical conducting paths, as well as mechanical connection or fastening of garment portions. As a further example, in some embodiments, electrical connector functionality can be integrated with releasable garment fasteners such as snap-fasteners or other fasteners that might be used to open or close a garment or other article such as, for example, a jacket or parka front, a tent flap, or other like opening. As yet another example, electrical connectors can be integrated into rivets or other like structures used to join garment portions or used to provide decorative features to the garment or other article.

Figure 8:
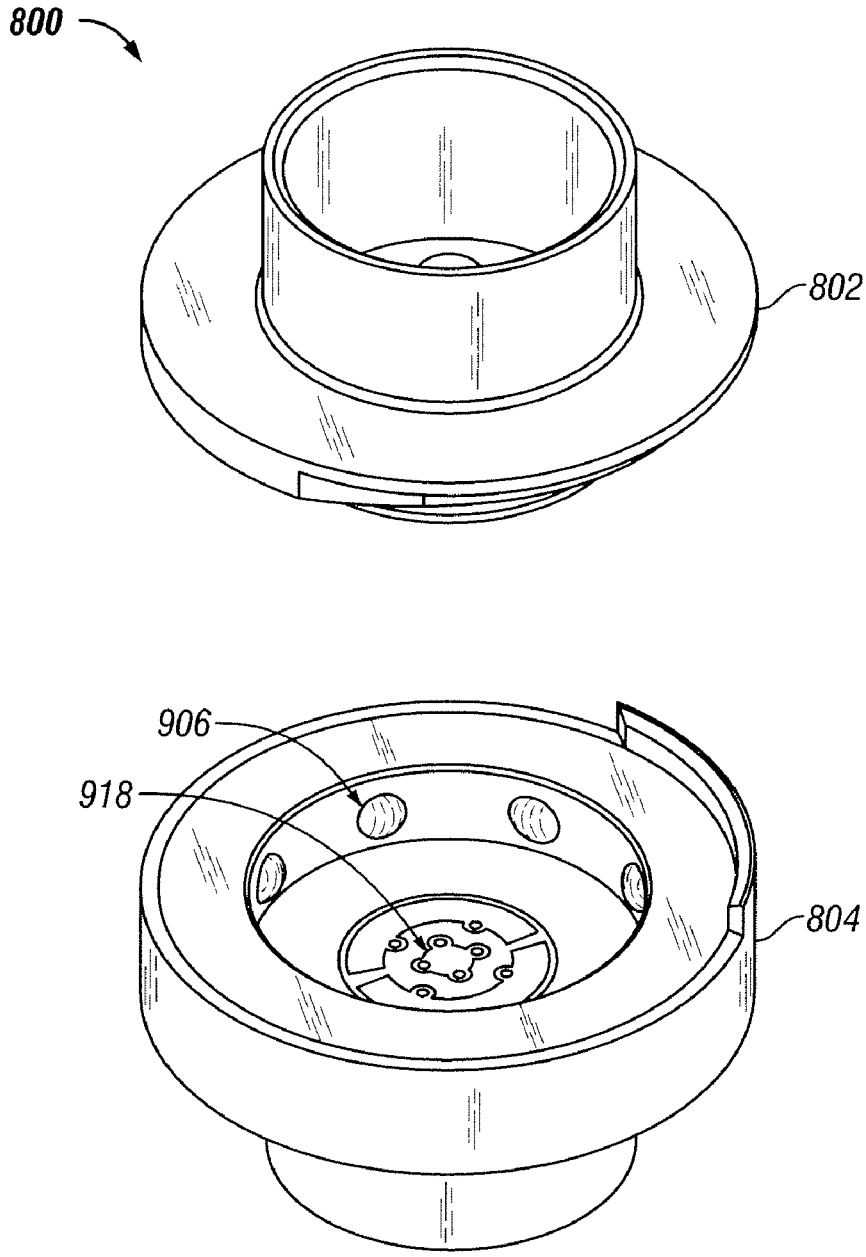
FIG. 8 is an illustration of an electrical connector for used with a seam incorporating electronic wiring in accordance with an embodiment of the technologies described herein.

FIG. 8 shows the two elements of such an electrical connector, 800 in accordance with one embodiment of the invention. The electrical connector 800 in this example includes two elements, a first connector element 802 and a second connector element 804. Second connector element 804 includes multiple spherical elements, or balls, 906 to facilitate proper mating and a connector element 918 for forming an electrical contact. The first and second connector elements are configured to be joined together such that electrical contacts housed therein close their respective circuits and allow current to flow. The first connector element 802 may be attached to one portion of an electrical garment and the second connector element 804 may be attached to another portion of an electrical garment. For example, multiple elements 802 might be along the edge of one side of the front of a jacket and corresponding elements 804 on the edge of the other side such that, upon closure, the circuits are mated and the jacket is also physically closed. A further embodiment provides the first connector element 802 on an electrical garment, such as a jacket, and the second connector element 804 on an attachable article such as, for example, a pouch or a hood. Yet a further embodiment can provide the first connector element 802 on an electrical garment such as, for example, a jacket or parka, and the second connector element 804 on an attachable electrical device or case or covering for an electrical device. In such applications, the electrical connector 800 can serve as a dual-purpose connector to provide electrical conductivity as well as mechanical fastenability. As will be appreciated by one of ordinary skill in the art after reading these examples, the placement of the first connector element 802 and second connector element 804 can be reversed.

Figure 9:
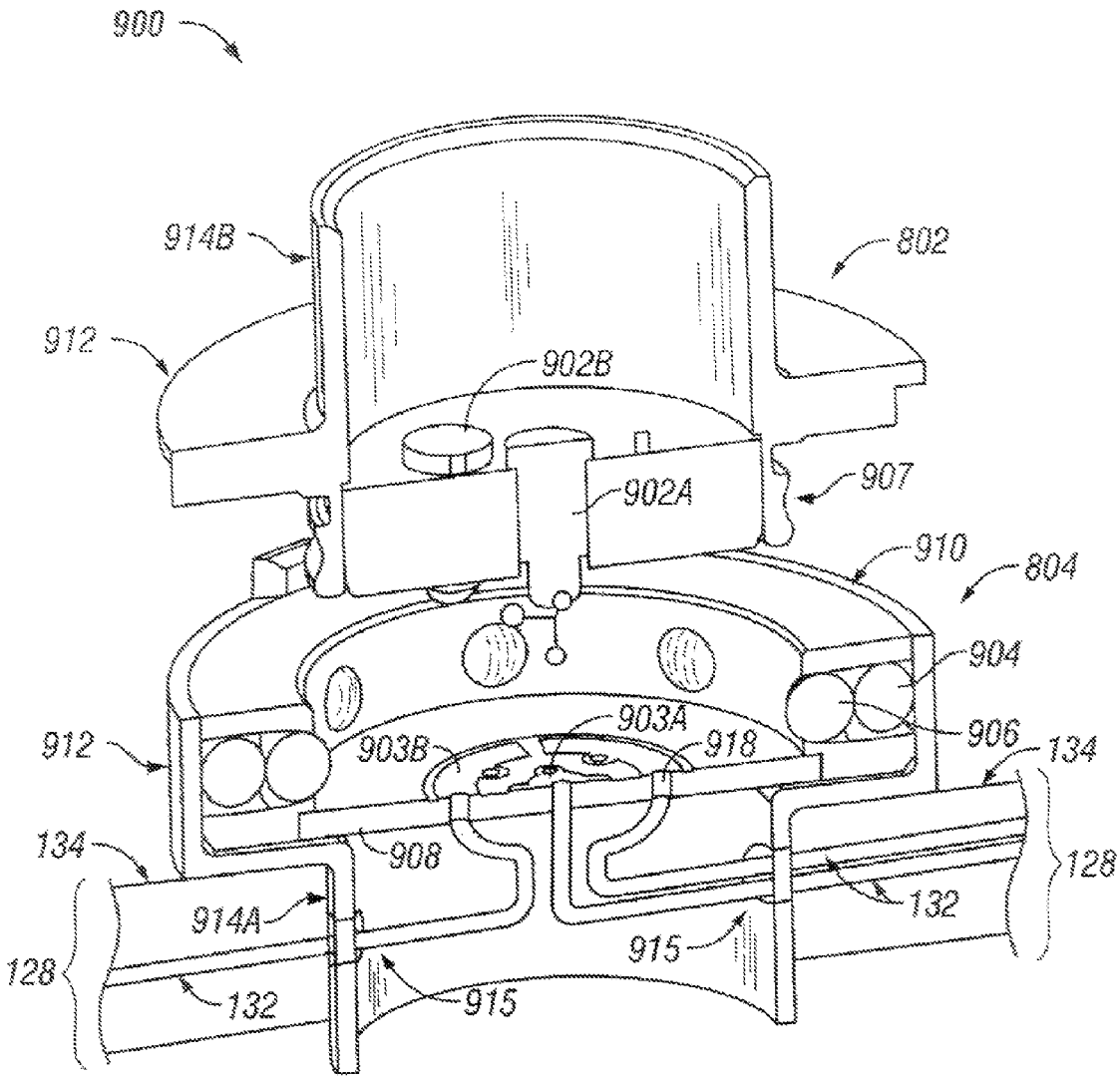
FIG. 9 is an illustration of an electrical connector assembly for use with a seam incorporating electronic wiring in accordance with an embodiment of the technologies described herein.

FIG. 9 shows additional details and construction of an electrical connector for use with a seam incorporating electronic wiring 132 in accordance with one embodiment of the invention. One of the connector elements 804 of the connector assembly 900 is shown inserted through a fabric panel 134 in FIG. 9. The other connector element 802 is shown in free space, unattached to a textile panel.

In the illustrated example, the contact 902A on the first connector element uses spring loaded pins to make electrical contact with an electrical contact 903A on the second connector element. Likewise, a pin 903B is shown as being positioned so as to make electrical contact with electrical contact 903B. The pins can be compression-spring loaded to allow the connector contact pins to compensate for vibration, twisting, and turning of the connector while maintaining a constant pressure between the contact surfaces.

The electrical contacts 903A, 903B of the second connector element 804 in this example are provided as metallic traces on a printed circuit board 908 contained within the body of connector element 804. The cut-away side view illustrates how electrical communication paths such as wires 132 from a wired seam may be routed through the an opening 915 in the housing to attach to the printed circuit board 908. Although not illustrated, housing 804 can also include openings in the body thereof, to allow wires 132 and other elements to be routed from a seam into the connector body. Although also not illustrated, ground connections can be made to connect her body elements 802, 804. This might be included, for example, to allow EMI shielding 140 to be grounded to connect or elements 802, 804. Likewise, in this manner, connector element 802 can pass the ground to connector element 804 and vice versa. Accordingly, if connector elements 802, 804 are grounded and passed through EMI fabric 144 riveting, EMI fabric 140 that becomes grounded as well.

The housing 804 illustrated in this example includes a ball cage 910, multiple balls 906, and an o-ring 904 for facilitating proper contact and retaining the first and second connector elements in electrical and mechanical contact. The o-ring 904 may be formed from various elastomers and other like materials based upon their physical durability, resistance to solvents and other chemicals, as well as their temperature range. O-rings 904 seal by deforming to the geometry of the cavity, called a gland, to which they are fitted.

During mating, grooved flange 907 of element 802 presses balls 906 into o-ring 904 allowing the larger-radius portion of the flange 907 to pass. After this larger portion passes, the balls are pushed back out by o-ring 904, forcing the balls into the grooved portion of flange 907. This provides a secure mating between elements 802 and 804.

Both the first and female second connector elements 802, 804 of the example connector assembly have a rivet post 914A, 914B to attach the electrical connector 900 to the garment. Once the first and second connector elements 802, 804 are attached to the garment and the seam incorporating electronic wiring are formed, the first and second connector elements can be aligned and then pressed together to fasten the two garment portions together and to complete the electrical circuit in the garment.

Figure 10:
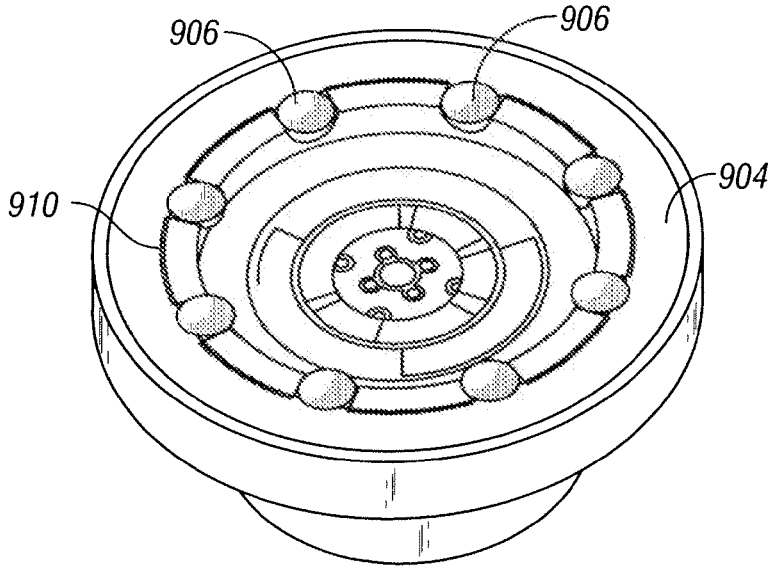
FIG. 10 is an illustration of a second connector element for use with an electrical connector assembly in accordance with an embodiment of the technologies described herein.

FIG. 10 shows the electrical contact surface of the second connector element in a plan view in accordance with one embodiment of the invention. The plan view shows a sectioned view of the multiple balls 906 and o-ring 904 that aid in retaining the first and second connector elements 802, 804 together to maintain electrical and mechanical contact. Balls 906 may be formed of aluminum, chromium, steel, hardened natural or synthetic rubber or other suitably durable material. The o-ring 904 may be formed of compressible material such as a polymer, rubber or other suitably elastomeric material.

Figure 11:
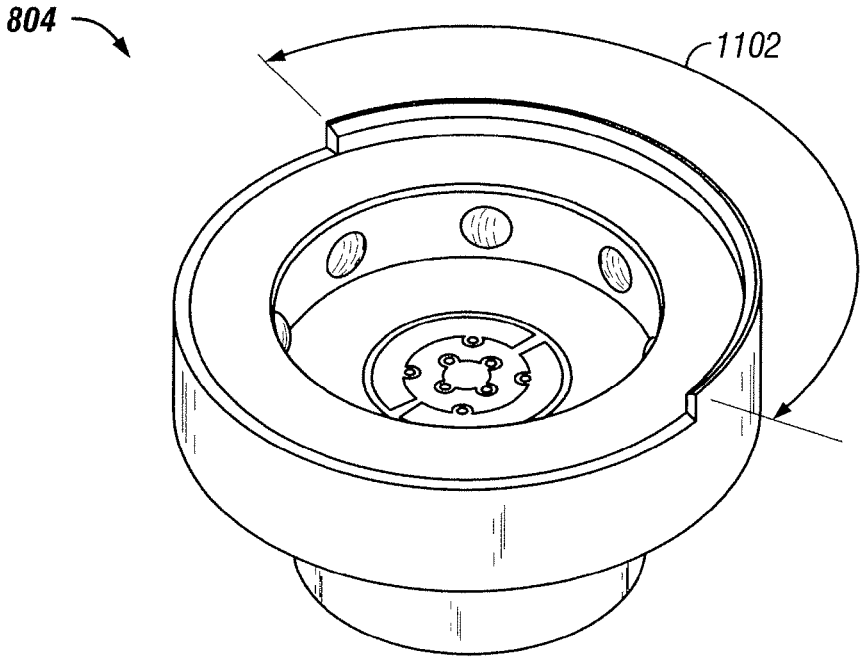
FIG. 11 is an illustration of an additional embodiment of a second connector element for use with an electrical connector assembly in accordance with an embodiment of the technologies described herein.

FIG. 11 shows a further embodiment of the second connector element, 804 in accordance with one embodiment of the invention. Second connector element 804 has a step-up lip 1102 to control an angle of freedom of rotation between the first and second connector elements 802, 804. The circumferential span of the lip 1102 controls the permitted rotational angle of freedom between the two elements 802, 804. For example, a complementary lip can be provided on mating element 802, but can be provided as small enough to allow mating element 802 to rotate with respect to element 804.

Figure 12:
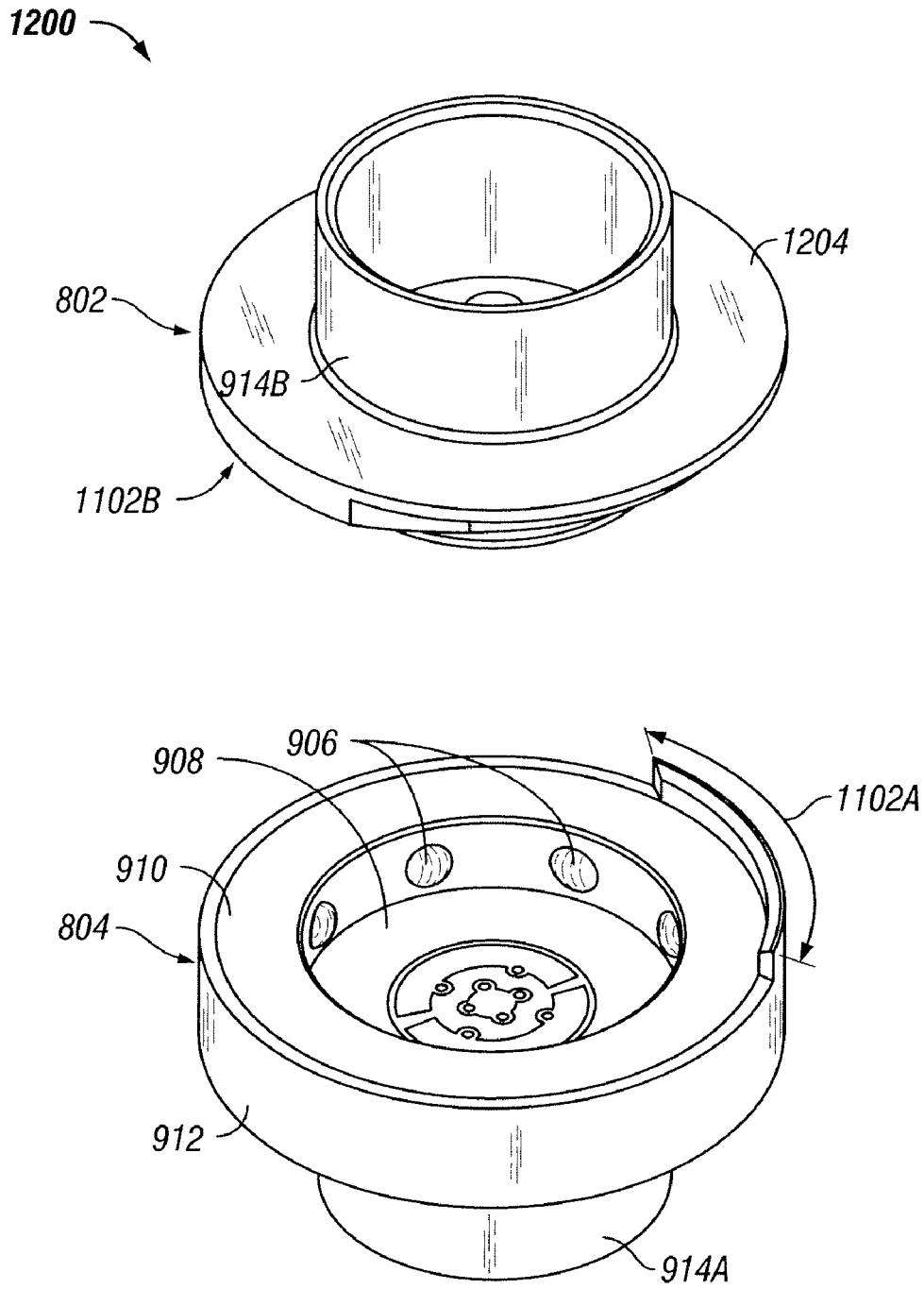
FIG. 12 is an illustration of the second connector element as joined with the first connector element to form an electrical connector assembly in accordance with an embodiment of the technologies described herein.

FIG. 12 shows the use of these elements to adjust the angle of freedom of rotation in the embodiment described above. Both the first connector element 802 and second connector element 804 are shown as an about-to-be-joined assembly, 1200. First connector element 802 includes a rivet post 914*b*, a housing 1204, and an angle of freedom lip 1102B. Second connector element 804 contains balls 906, a ball cage 910, a rivet post 914A, a housing 912, the PCB contact 908, and lip 1102A. Lip 1102*a* is the complement of angle of freedom 1102B.

In one embodiment, the complementary angles of freedom 1102A and 1102B complete a 360-degree circle when the first connector element and second connector element are joined together. In such embodiments, the lips 1102A, 1102B do not allow any freedom of rotation of the mated connector. However, one of the lips (for example 1102B) can be beveled to help guide the connector elements into mating alignment. In another embodiment, the lips 1102A, 1102B do not combine to complete a 360 degree circumference. As such, even after mating, the connector elements are free to rotate relative to one another. For example, assume that lip 1102A is an arcuate structure spanning 35 degrees and lip 1102B spans 205 degrees. Accordingly, the mated connector would have 120 degrees of rotational freedom. Such configurations might allow for easier connectivity because they are not as alignment sensitive, yet still limit rotation to some extent. Additionally, detents can be provided to allow the connector to be rotated to predetermined positions. For example, the contact patterns 903 on printed circuit board 208 can be arranged such that rotation of the elements causes the pins to rotate from one printed circuit board contact 903 to the next. Thus, a switching arrangement can be realized. The detents can be provided to help maintain a selected switch position.

Figure 13:
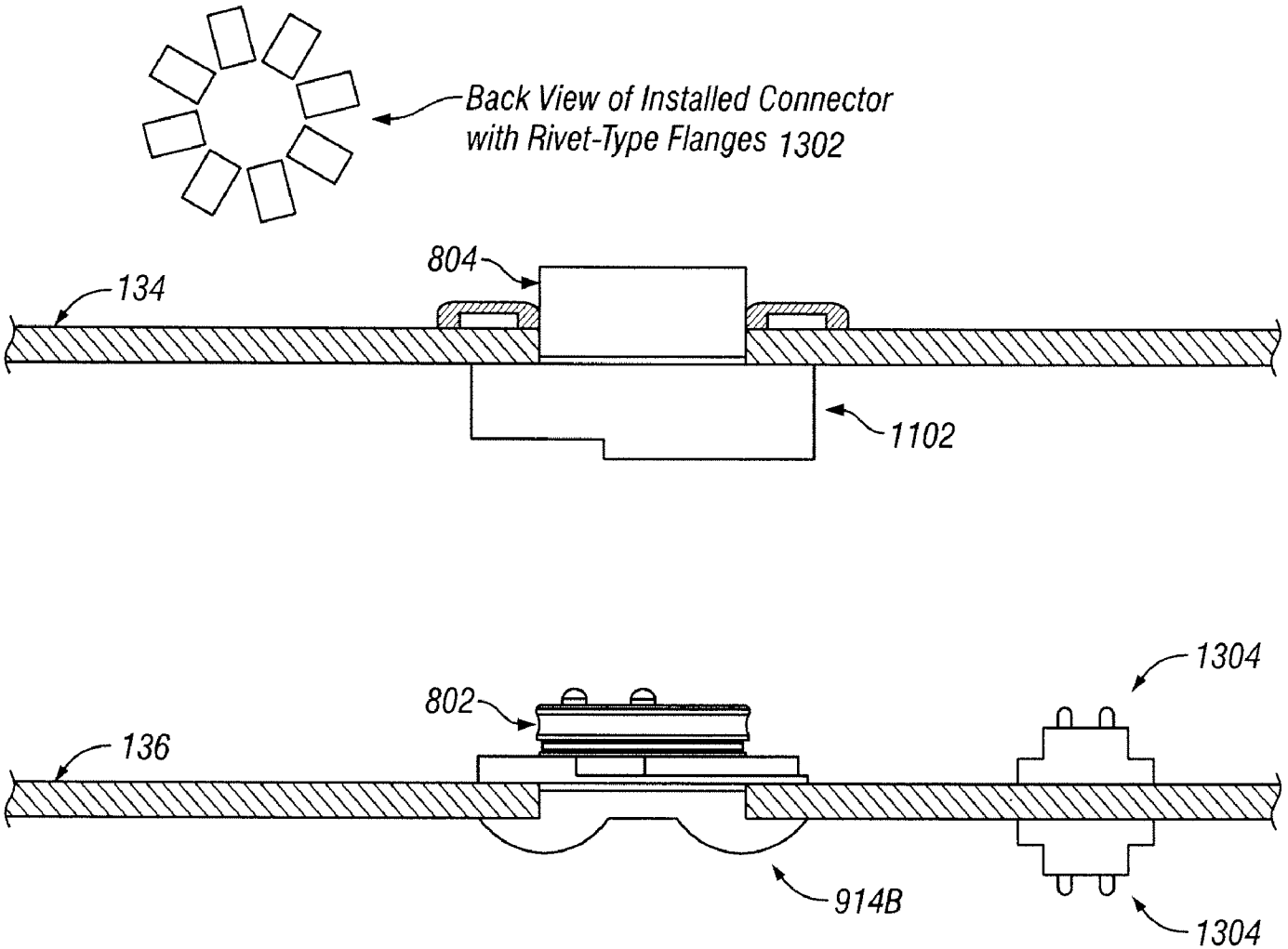
FIG. 13 is an illustration of the first and second connector elements mounted to fabric garment section and demonstrating the electrical and mechanical connection to be formed in accordance with an embodiment of the technologies described herein.

FIG. 13 shows a side view of the above-described embodiment of the first and second connector elements 802, 804 as installed on an electrical garment. In addition, a back view 1302 of the successfully installed connector is shown. The connector elements 802, 804 use a rivet-post type attachment. When attached and the rivet compressed, the flange forms the petal-type pattern shown at 1302, holding the element in place in the fabric. The fabric garment sections 134 and 136 are shown about to be joined by the electrical connector assembly. Fabric garment section 134 has a second connector element 802 riveted in place. Although not illustrated in FIG. 13, communication media 128 can be integrated in textile portions 134, 136 such as in a wired textile seam. An example of this is illustrated and described above with reference to FIG. 9.

Also illustrated in FIG. 13, is an example of two connector elements 1304 that can be positioned to a textile element and used for pass-through stacking of multiple connectors. The example illustrated is a symmetrical example where the connector elements are the same on the top and bottom faces of textile element 136. These elements can be environmentally sealed to provide improved performance in adverse conditions.

Figure 14:
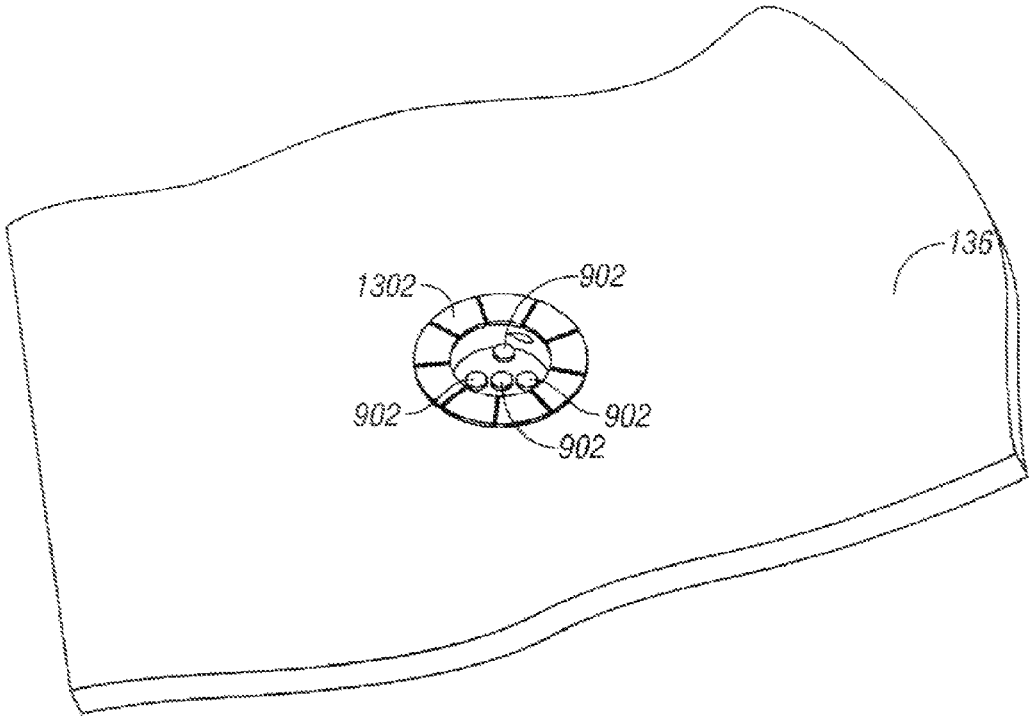
FIG. 14 is an illustration of the back side of the attachment of an electrical connector section to a fabric garment section according to an embodiment of the technologies described herein.

Attachment of the electrical connector first and second connector elements uses a rivet to attach each connector element to the fabric garment section. FIG. 14 illustrates the back view of an attached connector element. This diagram illustrates the riveted portion 1302 opened and pressed down onto fabric element 136 to hold the connector in place. The rivet may use a standard rivet or may be a split rivet as illustrated. In this diagram, the backs of electrical contact pins 902 can be seen. In one embodiment, wires can be soldered or otherwise connected to these pins 902 and potting material (not illustrated) can be used to ensure connectivity is maintained. Although these examples illustrate connectors configured as riveted connectors, other fastening mechanisms can be utilized as well. Additionally, although the connectors illustrated and described above are shown as releasable connectors, under releasable connectors can be provided as well. For example, conventional rivets have long been used to provide a rugged fixed seam. In such applications, a series of rivets is used to join two pieces of fabric. The rivets are fixed in that they cannot be connected and unconnected like snap fasteners. After reading this description, it will become apparent to one of ordinary skill in the art that the electrical connectivity properties described above can be utilized with these types of rivets as well. Accordingly, a rivet used to join two fabric sections together permanently can also be used to provide a conduit for electrical connectivity between the two sections utilizing the systems and methods described herein.

Figure 15:
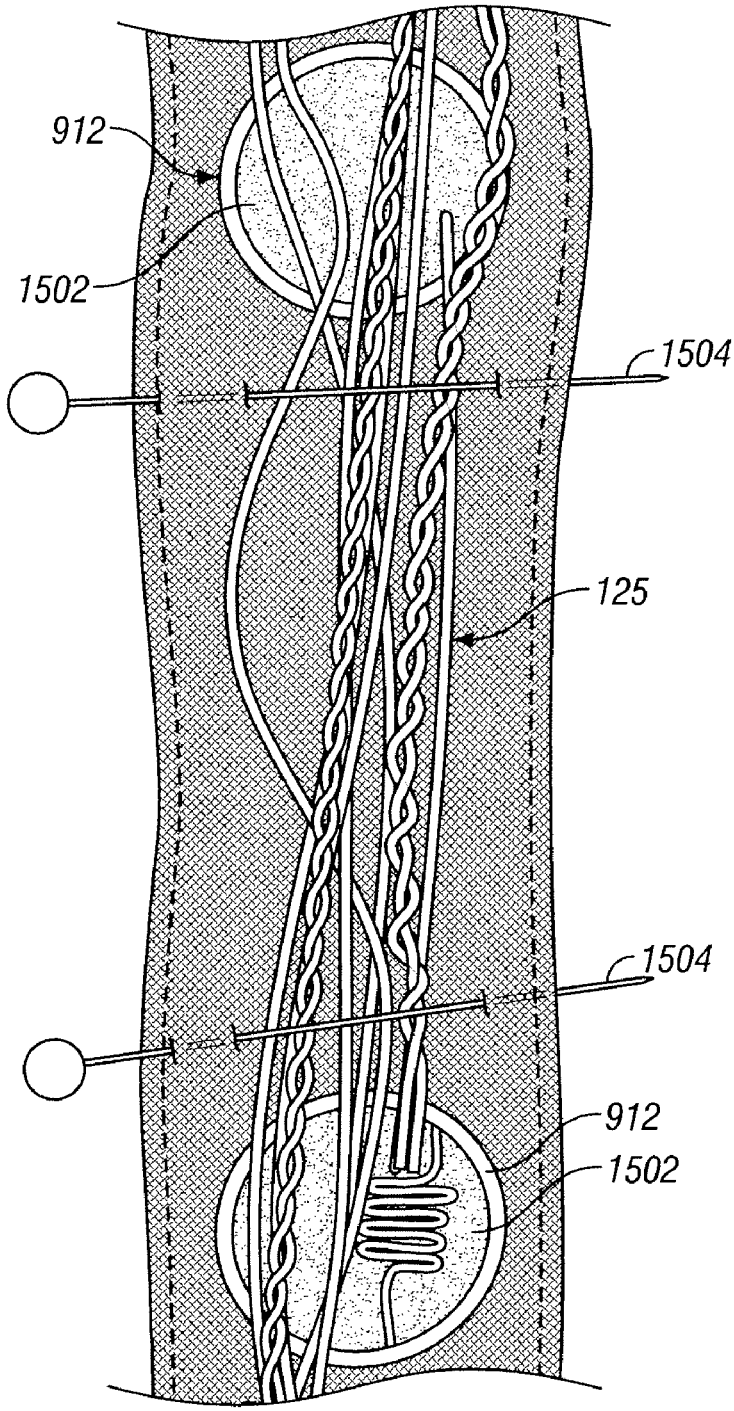
FIG. 15 is an illustration of a seam under construction incorporating electrical connectors in accordance with an embodiment of the technologies described herein.

The wiring and routing of communication media 140 can be planned and installed in the seams so as to allow connections with the electrical connector elements. One embodiment of the wiring and connector element construction is illustrated in FIG. 15, which depicts a fabric garment section with a portion of a seam incorporating electronic wiring during the construction of the seam. The seam has not yet been closed and the wires and braided coaxial conductors 125 are shown as being routed along the seam. Although not illustrated, as described above, EMI/heat sink fabric can be included as well. The connector bodies 912 are also shown. In this example, pins 1504 are used to guide the wires 125 to remain within the seam area and are removed upon completion of the seam.

As illustrated, some of the wiring elements are fed into the connector bodies 912 for electrical connection to the conductive elements of the respective connectors, while others pass by the connectors, not making an electrical connection thereto. FIG. 15 also shows the use of potting compound 1502 in the connector body. This can be included to hold the wires in place and act as a strain relief to help prevent the wire being pulled from the connector. Adding a strain relief prevents breakage of wires and conductors at the connector attachment point facilitating operation. This can also provide environmental shielding from the elements to help with corrosion resistance, for example. Preferably, the wires are allowed to flex and adapt to movement, facilitating fastening the connectors and wearing the garment.

Figure 16:
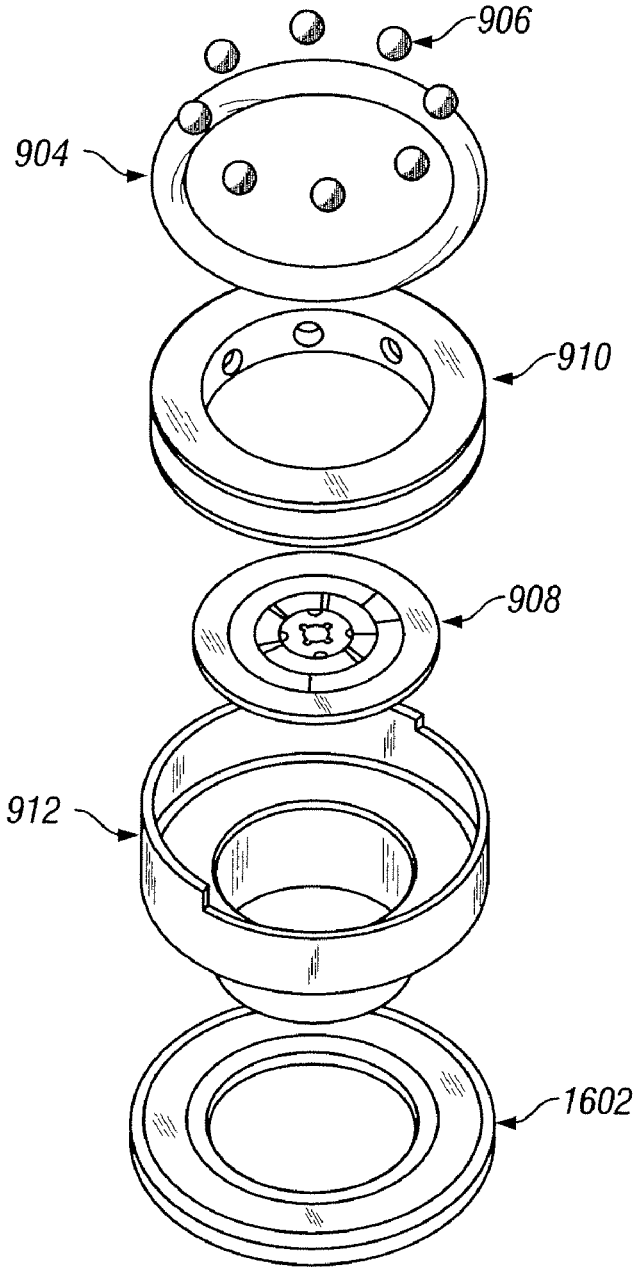
FIG. 16 is an exploded view illustration of a second connector element in accordance with an embodiment of the technologies described herein.

The first electrical connector element is comprised of a number of sub-elements, and an example of one assembly is illustrated in the exploded view drawing of FIG. 16. The balls 906 are installed with the O-ring 904 into the ball cage 910. The ball cage 910 and PCB element 908 are in turn installed into the housing 912. The completed first connector element is retained in the fabric by the rivet element 1602.

Figure 17:
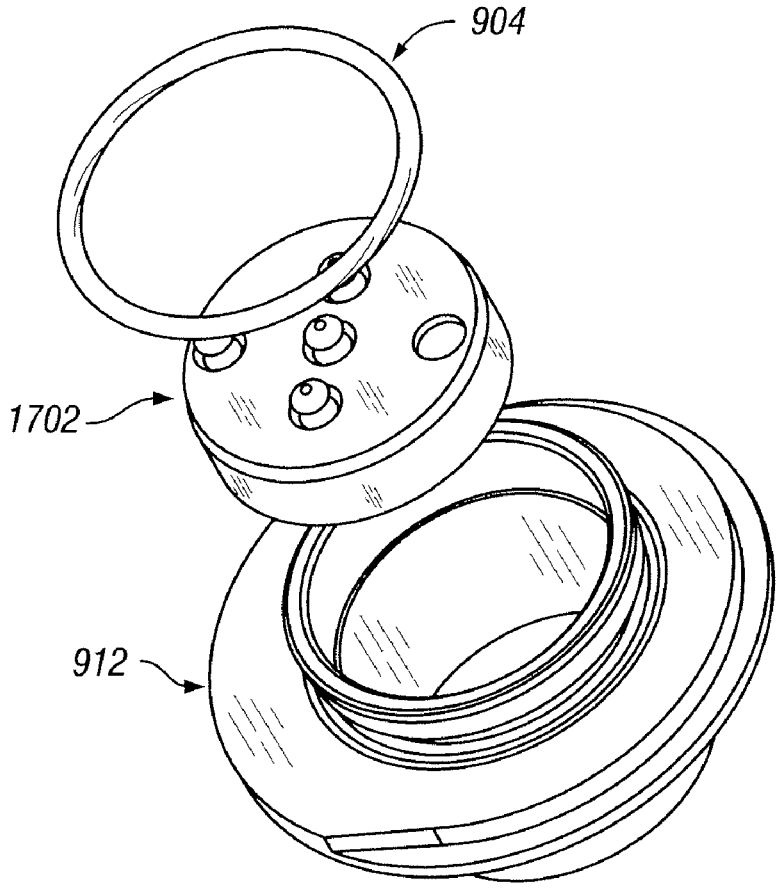
FIG. 17 is an exploded view illustration of a first connector element in accordance with an embodiment of the technologies described herein.

The second connector element is also comprised of a number of sub-elements, and an example of one assembly is illustrated in the exploded view drawing of FIG. 17. The o-ring 904 is used to retain contact portion 1706 within the connector housing 912. The completed second connector element is also retained in the fabric by a rivet element, although the rivet element is not shown in FIG. 17.

Further examples of electrical connection assemblies that can be integrated into the connector elements to provide electrical connectivity upon element mating can include those described in U.S. Pat. Nos. 7,297,002 and 7,335,067 and Patent Application Publication Nos. US 2007/026695 and WO 2007/015786, all of which are incorporated by reference herein in their entirety.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A communicative textile seam conduit, comprising:

first and second textile portions;

fastening elements configured to join the first and second textile portions to create a seam;

communication media disposed within the seam and configured to provide electromagnetic connectivity, between a plurality of electrical devices; and EMI/RFI shielding at least partially surrounding the communication media and disposed partially or completely within the seam.

2. The communicative textile seam conduit of claim 1, wherein the first and second textile portions are different panels of the garment.

3. The communicative textile seam conduit of claim 1, wherein the first and second textile portions are different portions of a same panel of the garment.

4. The communicative textile seam conduit of claim 1, wherein the fastening elements comprise stitching.

5. The communicative textile seam conduit of claim 1, wherein the EMI/RFI shielding comprises a tubular conductive material.

6. The communicative textile seam conduit of claim 1, wherein the EMI/RFI shielding comprises a plurality of portions of conductive material stitched or otherwise joined so as to partially or completely surround the communication media.

7. The communicative textile seam conduit of claim 1, wherein the EMI/RFI shielding comprises conductive fabric or a metallic mesh.

8. The communicative textile seam conduit of claim 1, further comprising a heat sink disposed at least partially within the seam.

9. The communicative textile seam conduit of claim 1, further comprising a temperature controlling medium disposed at least partially within the seam.

10. A communicative textile seam conduit, comprising:

first and second textile portions:

fastening elements configured to join the first and second textile portions to create a seam;

communication media disposed within the seam and configured to provide electromagnetic connectivity between a plurality of electrical devices; and an antenna disposed at least partially within the seam.

11. An electrical garment, comprising:

a plurality of textile portions;

fastening elements configured to join the plurality of textile portions to create the garment, the fastening elements creating a seam at the junction of two or more of the textile portions;

communication media disposed within the seam and configured to provide electromagnetic connectivity between a plurality of electrical devices; and EMI/RFT shielding at least partially surrounding the communication media and disposed partially or completely within the seam.

12. The electrical garment of claim 11, wherein the first and second textile portions are different panels of the garment.

13. The electrical garment of claim 11, wherein the first and second textile portions are different portions of a same panel of the garment.

14. The electrical garment of claim 11, wherein the fastening elements comprise stitching.

15. The electrical garment of claim 11, wherein the EMI/RFI shielding comprises a tubular conductive material.

16. The electrical garment of claim 11, wherein the EMI/RFI shielding comprises a plurality of portions of conductive material stitched or otherwise joined so as to partially or completely surround the communication media.

17. The electrical garment of claim 11 wherein the EMI/RFI shielding comprises conductive fabric or a metallic mesh.

18. The electrical garment of claim 11, further comprising a heat sink disposed at least partially within the seam.

19. The electrical garment of claim 11, further comprising a temperature controlling medium disposed at least partially within the seam.

20. The electrical garment of claim 11, further comprising a plurality of electrical devices attached to the garment and electrically coupled to the communication media.

21. An electrical garment, comprising:

a plurality of textile portions:

fastening elements configured to join the plurality of textile portions to create the garment, the fastening elements creating a seam at the junction of two or more of the textile portions;

communication media disposed within the seam and configured to provide electromagnetic connectivity between a plurality of electrical devices; and an antenna disposed at least partially within the seam.

22. An electrical garment, comprising:

a plurality of textile portions;

fastening elements configured to join the plurality of textile portions to create the garment, the fastening elements creating a seam at the junction of two or more of the textile portions;

communication media disposed within the seam and configured to provide electromagnetic connectivity between a plurality of electrical devices;

electrical connectors for providing electromagnetic connectivity between the seam and an additional textile portion; and EMI/RFI shielding at least partially surrounding the communication media and disposed partially or completely within the seam.

23. The electrical garment of claim 22, wherein the first and second textile portions are different panels of the garment.

24. The electrical garment of claim 22, wherein the first textile portion is a panel of the garment and the second textile portion is a separate garment.

25. The electrical garment of claim 22, wherein the seam incorporates an electrical connector.

26. An electrical garment, comprising:

a plurality of textile portions;

fastening elements configured to join the plurality of textile portions to create the garment, the fastening elements creating a seam at the junction of two or more of the textile portions;

communication media disposed within the seam and configured to provide electromagnetic connectivity between a plurality of electrical devices;

electrical connectors for providing electromagnetic connectivity between the seam and an additional textile portion; and an antenna disposed at least partially within the seam.

* * * * *